US010711775B2

(12) United States Patent
Hashimoto

(10) Patent No.: US 10,711,775 B2
(45) Date of Patent: Jul. 14, 2020

(54) COMPACT PUMP AND DIAPHRAGM ASSEMBLY USED THEREIN

(71) Applicant: Tomoyuki Hashimoto, Tokyo (JP)

(72) Inventor: Tomoyuki Hashimoto, Tokyo (JP)

(73) Assignee: MITSUMI ELECTRIC CO., LTD., Tokyo (JP)

( * ) Notice: Subject to any disclaimer, the term of this patent is extended or adjusted under 35 U.S.C. 154(b) by 253 days.

(21) Appl. No.: 15/569,627

(22) PCT Filed: Apr. 26, 2016

(86) PCT No.: PCT/JP2016/063026
§ 371 (c)(1),
(2) Date: Oct. 26, 2017

(87) PCT Pub. No.: WO2016/175199
PCT Pub. Date: Nov. 3, 2016

(65) Prior Publication Data

US 2018/0119694 A1 May 3, 2018

(30) Foreign Application Priority Data

Apr. 27, 2015 (JP) ..... 2015-090301

(51) Int. Cl.

| | |
|---|---|
| ***F04B 45/04*** | (2006.01) |
| ***F04B 43/00*** | (2006.01) |
| ***F04B 43/04*** | (2006.01) |
| ***F04B 45/027*** | (2006.01) |
| ***F04B 53/10*** | (2006.01) |
| ***F04B 53/12*** | (2006.01) |
| ***F04B 53/00*** | (2006.01) |
| ***F04B 53/16*** | (2006.01) |

(52) U.S. Cl.
CPC ..... *F04B 45/043* (2013.01); *F04B 43/0045* (2013.01); *F04B 43/0054* (2013.01);
(Continued)

(58) Field of Classification Search
CPC ..... F04B 53/001; F04B 53/1047; F04B 53/1027; F04B 53/1045; F04B 53/123;
(Continued)

(56) References Cited

U.S. PATENT DOCUMENTS 6,206,664 B1 3/2001 Kakizawa
7,527,595 B2 * 5/2009 Hori ..... A61B 5/02 251/264
(Continued)

FOREIGN PATENT DOCUMENTS

JP 2000-320463 A 11/2000
JP 2002-005029 A 1/2002
(Continued)

OTHER PUBLICATIONS

EP-EESR 16786476.8 on Oct. 11, 2018.

*Primary Examiner* — Bryan M Lettman
*Assistant Examiner* — Timothy P Solak
(74) *Attorney, Agent, or Firm* — W&C IP

(57) ABSTRACT

A compact pump includes a case, a diaphragm assembly disposed in the case at an upper position and includes diaphragm units which form respective pump chambers, and a swing body disposed in the case at a lower position and moves the plural diaphragm units in the top-bottom direction. The diaphragm assembly has intake valve elements for opening and closing respective air introduction holes. An upper cover of the case has an exhaust hole and ring-shaped recesses. The upper cover has tubular inner wall surfaces defining the respective ring-shaped recesses. The diaphragm assembly includes tubular exhaust valve elements which are disposed in the respective ring-shaped recesses so as to contact the plural respective tubular inner wall surfaces and a rib which is disposed at its center in the vicinity of the exhaust hole and connects center-side outer wall surfaces of the tubular exhaust valve elements.

18 Claims, 28 Drawing Sheets

(52) U.S. Cl.
CPC ..... *F04B 43/04* (2013.01); *F04B 45/027* (2013.01); *F04B 45/045* (2013.01); *F04B 53/001* (2013.01); *F04B 53/1047* (2013.01); *F04B 53/123* (2013.01); *F04B 53/16* (2013.01); *F04B 2201/0604* (2013.01)

(58) Field of Classification Search
CPC .... F04B 45/045; F04B 43/0045; F04B 27/00; F04B 39/1046; F04B 45/027; F04B 2201/0604; F04B 2201/0804; F04B 2203/0211; F04B 45/043
See application file for complete search history.

(56) References Cited

U.S. PATENT DOCUMENTS

| | | | | |
|---|---|---|---|---|
| 2003/0031571 | A1* | 2/2003 | Yamakawa ..... | F04B 43/0045 417/412 |
| 2003/0086803 | A1 | 5/2003 | Fukami et al. | |
| 2005/0047934 | A1 | 3/2005 | Nawa | |
| 2005/0049513 | A1 | 3/2005 | Hori | |
| 2005/0169780 | A1 | 8/2005 | Fukami et al. | |
| 2013/0136637 | A1* | 5/2013 | Chang ..... | F04B 41/00 417/437 |
| 2014/0099222 | A1 | 4/2014 | Yu | |
| 2014/0161654 | A1* | 6/2014 | Dorfler ..... | F04B 43/0045 417/443 |

FOREIGN PATENT DOCUMENTS

| | | | |
|---|---|---|---|
| JP | 2003-269337 | A | 9/2003 |
| JP | 2004-225608 | A | 8/2004 |
| JP | 2005-076532 | A | 3/2005 |
| JP | 2005-076535 | A | 3/2005 |
| JP | 2005-146942 | A | 6/2005 |
| JP | 2008-196406 | A | 8/2008 |
| JP | 4306097 | A | 5/2009 |
| JP | 2012-241636 | A | 12/2012 |
| JP | 2013-002347 | A | 1/2013 |

* cited by examiner

Prior Art

Prior Art

Prior Art

Prior Art

Prior Art

Prior Art

Prior Art

Prior Art

COMPACT PUMP AND DIAPHRAGM ASSEMBLY USED THEREIN

TECHNICAL FIELD

The present invention relates to a compact pump. More particularly, the invention relates to a compact pump that is used for supplying air to a blood pressure monitor, for example, and employs a diaphragm assembly.

BACKGROUND ART

Compact pumps of this type are equipped with a diaphragm assembly including plural diaphragm units which form plural respective pump chambers in a case, and perform a pumping operation in such a manner that a bottom end portion of each diaphragm unit is moved in the top-bottom direction by a swing body that is swung by an eccentric rotary shaft. Compact pumps of this type take in and exhaust (discharge) air as an intake valve element and an exhaust valve element operate in link with the movement, in the top-bottom direction, of the bottom end portion of each diaphragm unit.

Such compact pumps are called diaphragm pumps because of the use of the diaphragm assembly. The diaphragm assembly is also called a diaphragm collection or a diaphragm main body. Each intake valve element is also called a suction valve or a suction valve element. Each exhaust valve element is also called a discharge valve or a discharge valve element. The swing body and the eccentric rotary shaft are also called a drive body and a drive shaft, respectively.

In such compact pumps, the intake valve elements (suction valves, suction valve elements) and the exhaust valve elements (discharge valves, discharge valve elements) perform opening/closing operations as air is taken in and exhausted (discharged). As a result, operating sounds are generated when these valve elements (valves) perform opening/closing operations. This results in a problem that the operating sounds leak to outside the case to become noise (noise sounds). Likewise, intake sounds (suction sounds) are generated when air is sucked into the case from outside the case. This results in another problem that the intake sounds leak to outside the case to become noise (noise sounds).

To solve the above problems, various techniques for preventing (suppressing) of noise (noise sounds) have been proposed conventionally.

Patent document 1: JP 2003-269337 A
Patent document 2: JP 4,306,097 B
Patent document 3: JP 2012-241636 A For example, Patent document 1 discloses a diaphragm pump in which noise sounds that are generated when suction valves are opened and closed are suppressed. In the diaphragm pump disclosed in Patent document 1, suction valves are provided in a flat-plate-shaped portion to which diaphragm units of a diaphragm main body are connected. Each suction valve has a thin valve portion and an opening that is formed, for example, around the valve portion. In each suction valve, the surface, located on the side where a suction hole is formed on a cylinder, of the valve portion has a concave portion. In the diaphragm pump disclosed in Patent document 1, a discharge valve is disposed approximately at the center of the plural diaphragm units. A discharge outlet is disposed over the discharge valve.

In the diaphragm pump disclosed in Patent document 1, only a portion, around the concave portion, of each suction valve comes into contact with the surface of the cylinder, whereby the generation of noise sounds can be suppressed.

Patent document 2 discloses a compact pump in which noise generated by intake valve elements is weakened. In the compact pump disclosed in Patent document 2, each diaphragm has a through-hole in its bottom portion at the center. A swing body has air introduction holes which communicate with the respective through-holes. Each intake valve element is formed by cutting away a part of the diaphragm. An intake valve portion is formed by the intake valve element and the through-hole which are formed in the bottom portion of each diaphragm. A case upper plate has one exhaust hole at the center. The case upper plate has, around the exhaust hole, plural ring-shaped recesses which communicate with the exhaust hole. Each exhaust valve element is inserted in the associated ring-shaped recess and the exhaust hole. The exhaust valve elements are top end portions of the diaphragms, respectively, and are have a cylindrical shape. Exhaust valve portions are formed in such a manner that the exhaust valve elements are brought into pressure contact with inner wall surfaces that define the ring-shaped recesses and a wall surface that define the exhaust hole, respectively.

In the compact pump disclosed in Patent document 2, since the intake valve elements are housed in the case completely, operating sounds of the intake valve elements are muffled in the case and noise decreases that leaks to outside the case.

Patent document 3 discloses a diaphragm pump in which noise sounds that originate from suction sounds are weakened. In the diaphragm pump disclosed in Patent document 3, a diaphragm holder which holds a diaphragm is provided with muffling chambers. Fluid that has been sucked through a suction inlet flows into a muffling chamber, passes through another muffling chamber, and flows into a pump chamber via a suction hole. When the pump chamber is contracted thereafter, the fluid is pushed out of the pump chamber, flows through one discharge hole, and supplied to a pressurization target from a discharge outlet. In the diaphragm pump disclosed in Patent document 3, one discharge valve element is disposed approximately at the center of plural diaphragm units. The discharge outlet is disposed over the discharge valve element.

In the diaphragm pump disclosed in Patent document 3, noise sounds originating from suction sounds can be weakened because fluid that has flown into the diaphragm pump is guided to a muffling chamber immediately.

SUMMARY OF THE INVENTION

Problems to Be Solved by the Invention

The techniques of the above Patent documents 1-3 have the problems described below.

In each of Patent documents 1-3, no consideration is given to operating sounds that are generated when the exhaust valve element(s) (discharge valve(s), discharge valve element(s)) are opened and closed. That is, the compact pumps (diaphragm pumps) disclosed in Patent documents 1-3 have a problem that operating sounds of the exhaust valve element(s) (discharge valve(s), discharge valve element(s)) leak, as they are (i.e., without being weakened inside the pump), to outside the case as noise (noise sounds).

More specifically, in Patent document 1, the discharge outlet is disposed over the discharge valve. As a result, operating sounds of the discharge valve leak, as they are, to outside the case as noise (noise sounds) through the discharge outlet.

In Patent document 2, each exhaust valve element is the top end portion of the diaphragm it belongs. As a result, operating sounds of each exhaust valve element leak, as they are, to outside the case as noise (noise sounds) through the one exhaust hole which is provided in the case upper plate at the center.

In Patent document 3, as in Patent document 1, the discharge outlet is disposed over the discharge valve element. As a result, operating sounds of the discharge valve leak, as they are, to outside the case as noise (noise sounds) through the discharge outlet.

An object of the present invention is therefore to provide a compact pump and a diaphragm assembly used therein capable of weakening noise sounds without increasing the number of components.

Other objects of the invention will become apparent as the description proceeds.

Means for Solving the Problems

A first exemplary mode of the invention provides a compact pump comprising:

- a hollow case which is symmetrical with respect to a motor rotation axis;
- a diaphragm assembly which is disposed in the case at an upper position and includes first to Nth diaphragm units which form first to Nth pump chambers, respectively, N being an integer that is larger than or equal to 2; and
- a swing body which is disposed in the case at a lower position and moves the first to Nth diaphragm units in the top-bottom direction when swung by an eccentric rotary shaft, characterized in that
- the first to Nth diaphragm units have first to Nth through-holes at centers of bottom portions thereof, respectively;
- the swing body has first to Nth air introduction holes which communicate with the first to Nth through-holes, respectively; that the diaphragm assembly has first to Nth intake valve elements which open and close the first to Nth air introduction holes, respectively;
- the case has an upper cover which is provided at an upper portion of the case;
- the upper cover has an exhaust hole formed along the motor rotation axis and first to Nth ring-shaped recesses which are disposed around and communicate with the exhaust hole;
- the upper cover has first to Nth tubular inner wall surfaces which define the first to Nth ring-shaped recesses, respectively;
- the diaphragm assembly has first to Nth tubular exhaust valve elements which are disposed in the first to Nth ring-shaped recesses in a state that the first to Nth tubular exhaust valve elements are in contact with the first to Nth tubular inner wall surfaces, respectively; and
- the diaphragm assembly has a rib which is disposed at a center of the diaphragm assembly in a vicinity of the exhaust hole and connects center-side outer wall surfaces of the first to Nth tubular exhaust valve elements.

A second exemplary mode of the invention provides a diaphragm assembly used in a compact pump, comprising:

- first to Nth diaphragm units which form first to Nth pump chambers, respectively, around a motor rotation axis (MA), N being an integer that is larger than or equal to 2;
- first to Nth intake valve elements which are formed at the centers of bottom portions of the first to Nth diaphragm units by cutting away parts of them, respectively;
- first to Nth flanges which project outward from top ends of the first to Nth diaphragm units, respectively;
- first to Nth tubular exhaust valve elements which project upward from the first to Nth flanges and are thereby connected to the first to Nth diaphragm units, respectively; and
- a rib which is disposed at a center portion in a vicinity of an exhaust hole of the compact pump and connects center-side outer wall surfaces of the first to Nth tubular exhaust valve elements.

Advantages of the Invention

The invention makes it possible to weaken noise sounds without increasing the number of components.

DESCRIPTION OF RELATED ART

First, to facilitate understanding of the present invention, a technique relating to the invention will be described below with reference to the related drawings. Although the related technique described below is substantially the same as the compact pump disclosed in the above-described Patent document 2, the related technique is not completely the same as the technique disclosed in Patent document 2 but is a more detailed one with some modifications.

Figure 1:
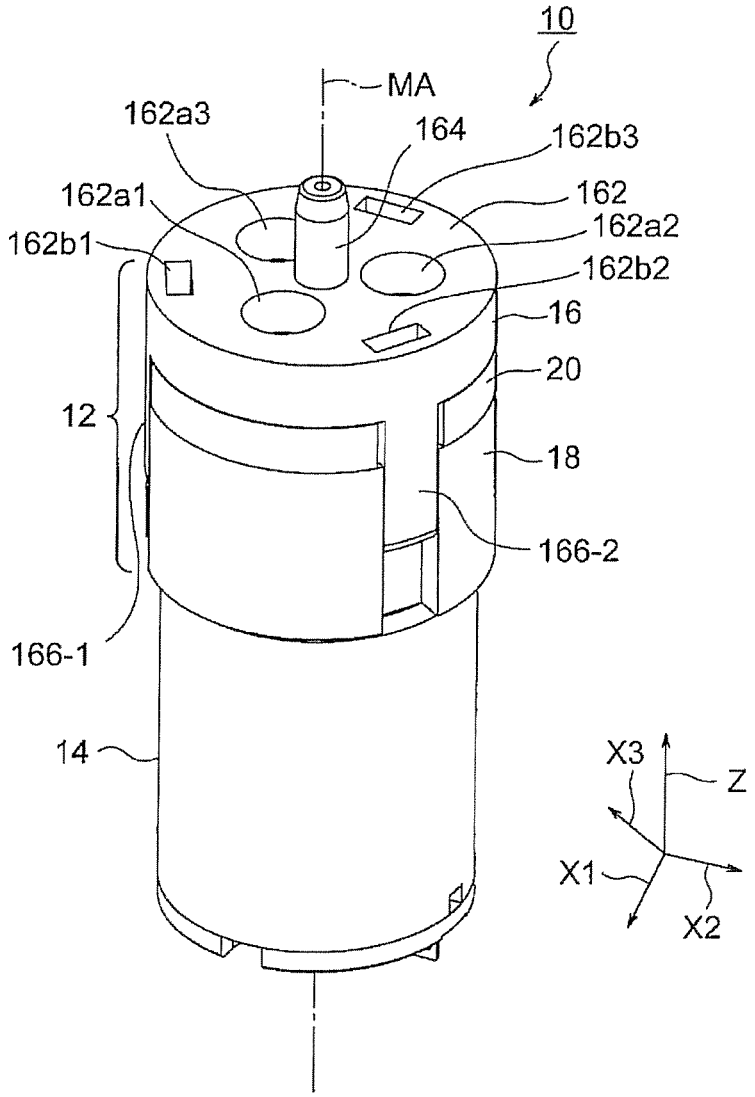
FIG. 1 is a perspective view showing an appearance of a compact pump of a related technique.
Figure 2:
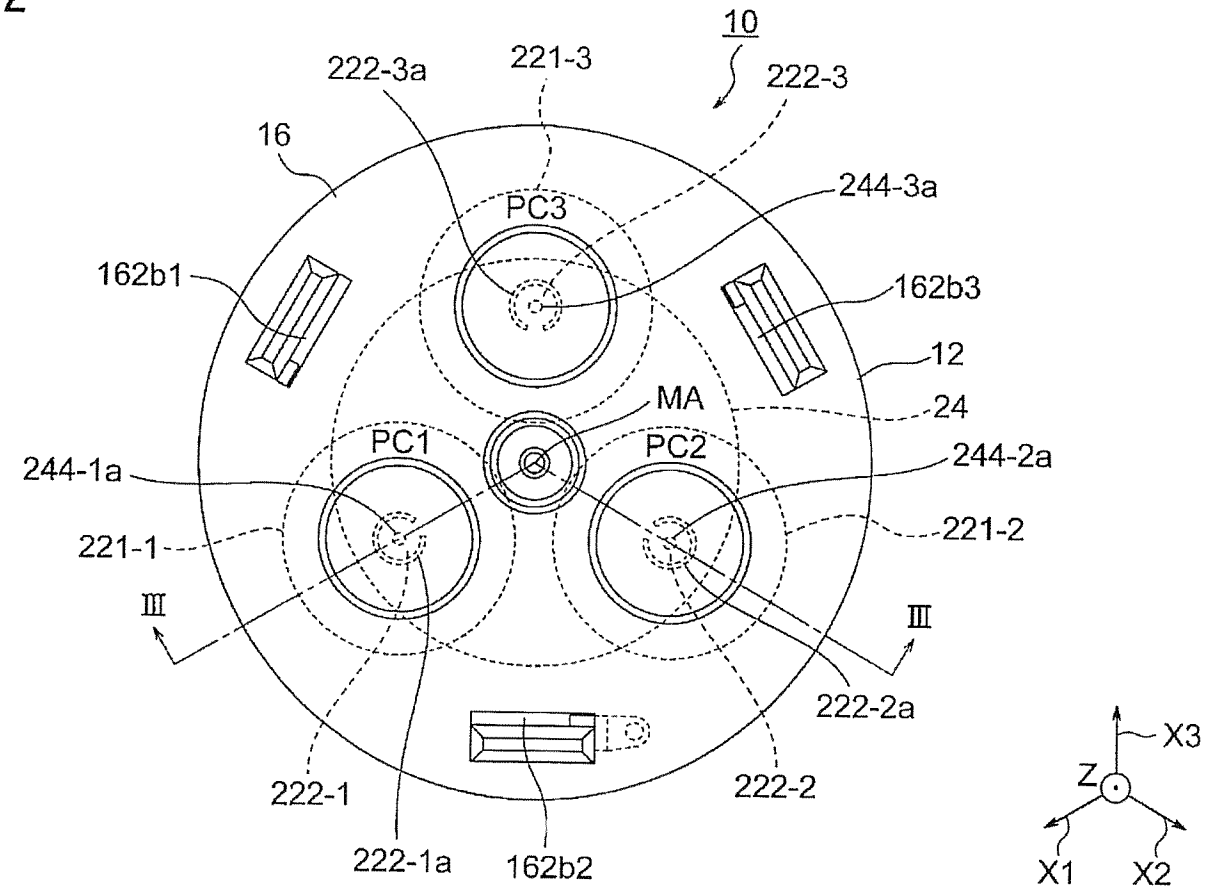
Fig. 2 Prior Art
FIG. 2 is a plan view of the compact pump shown in FIG. 1.
Figure 3:
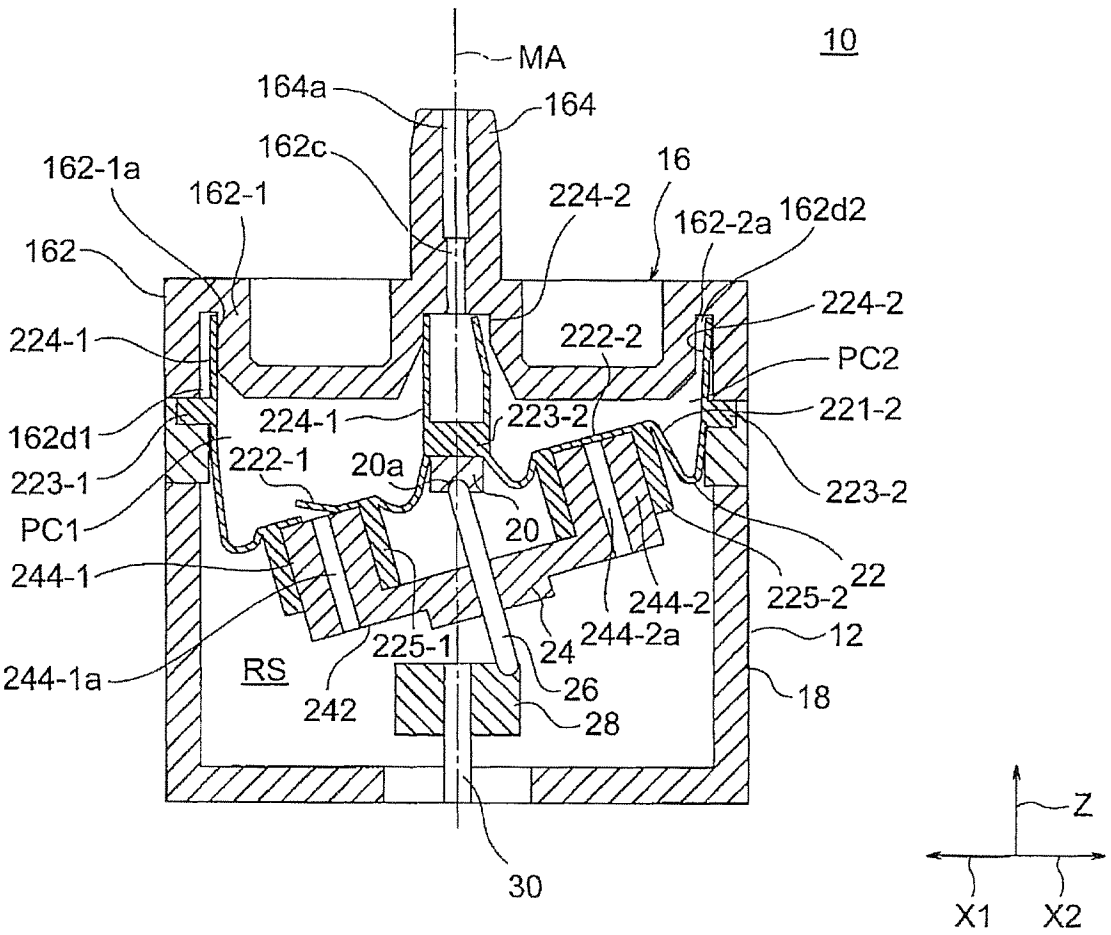
Prior Art Fig. 3
FIG. 3 is a vertical sectional view taken along line III-III in FIG. 2.

FIGS. 1-3 shows an appearance of a compact pump 10 of the related technique. FIG. 1 is a perspective view showing an appearance of the compact pump 10, FIG. 2 is a plan view of the compact pump 10, and FIG. 3 is a vertical sectional view taken along line III-III in FIG. 2.

As will become apparent as the description proceeds, the illustrated compact pump 10 has a substantially N-fold rotation-symmetrical shape (N: integer that is larger than or equal to 2) with respect to a motor rotation axis MA. That is, the compact pump 10 becomes substantially congruent with the original shape even if it is rotated in its entirety by 360°/N about the motor rotation axis MA. In the illustrate example, N is equal to 3. That is, the illustrated compact pump 10 has a 3-fold symmetrical structure which means that it comes to lie on itself when rotated by 120° about the motor rotation axis MA.

The following description will employ a coordinate system (X1, X2, X3, Z) shown in FIGS. 1-3. In the state shown in FIGS. 1-3, in the coordinate system (X1, X2, X3, Z), the Z direction is the top-bottom direction (vertical direction) in which the motor rotation axis MA extends and the X1, X2, and X3 directions are first to third horizontal directions, respectively, that deviate from each other by the same angle (120°) around the motor rotation axis MA (Z direction) in a plane that is perpendicular to the motor rotation axis MA (Z direction).

More specifically, the X1 direction is assumed to be a reference direction. In this case, the X2 direction is a direction that is rotated counterclockwise about the motor rotation axis MA by 120° from the X1 direction. The X3 direction is a direction that is rotated counterclockwise about the motor rotation axis MA by 240° from the X1 direction. In the illustrated related technique, the X1 direction, the X2 direction, the X3 direction, and the Z direction are also called a first direction, a second direction, a third direction, and a fourth direction, respectively.

The terms "top" and "bottom" that are used in the specification to describe directions are directions that are employed in the drawings for convenience of description, and do not necessary coincide with the top and bottom that occur when the compact pump of the related technique is used actually.

The illustrated compact pump 10 is equipped with a hollow case 12 that is symmetrical in shape with respect to the motor rotation axis MA and a motor 14 which is a drive source attached to the bottom of the case 12. The motor 14 may be fixed to the case 12 by any of various methods. For example, the motor 14 may be fastened to the case 12 by fastening members such as bolts or bonded to the case 12 using adhesive, or may be fixed to the case 12 using both of these methods. The motor 14 is omitted in FIG. 3.

As shown in FIG. 1, the case 12 has an upper cover 16 as its upper portion, a lower case 18 as its lower portion, and a supporting-point plate 20 which is sandwiched between the upper cover 16 and the lower case 18. The upper cover 16 is also called a discharge cover.

As shown in FIG. 1, the upper cover 16 has a cover plate 162 having a cylindrical external shape and a discharge pipe 164 which projects upward from the center of the cover plate 162 along the motor rotation axis MA. A discharge hole 164*a* (see FIG. 3) is formed through the discharge pipe 164. The upper cover 16 further has first to third hooks 166-1, 166-2, and 166-3 which extend downward from an outer circumferential wall of the cover plate 162 and serve to fix the supporting-point plate 20 by holding it among them in cooperation with the lower case 18. However, the third hook 166-3 is not shown in FIG. 1.

The first hook 166-1 is disposed in a direction between the third horizontal direction X3 and the first horizontal direction X1 (these directions are defined around the motor rotation axis MA). In other words, the first hook 166-1 extends from the motor rotation axis MA in the direction opposite to the second horizontal direction X2. The second hook 166-2 is disposed in a direction between the first horizontal direction X1 and the second horizontal direction X2 (these directions are defined around the motor rotation axis MA). In other words, the second hook 166-2 extends from the motor rotation axis MA in the direction opposite to the third horizontal direction X3. Although not shown in FIG. 1, the third hook 166-3 is disposed in a direction between the second horizontal direction X2 and the third horizontal direction X3 (these directions are defined around the motor rotation axis MA). In other words, the third hook 166-3 extends from the motor rotation axis MA in the direction opposite to the first horizontal direction X1.

The cover plate 162 has first to third cylindrical recesses 162*a*1, 162*a*2, and 162*a*3 which are arranged around the motor rotation axis MA so as to exist in the first to third horizontal directions X1, X2, and X3, respectively. To enable formation of the first to third hooks 166-1, 166-2, and 166-3, the cover plate 162 is formed with first to third hook formation rectangular holes 162*b*1, 162*b*2, and 162*b*3 close to the respective first to third hooks 166-1, 166-2, and 166-3.

As shown in FIG. 3, the compact pump 10 is equipped with, inside the case 12, a diaphragm assembly 22 and a swing body 24.

Figure 4:
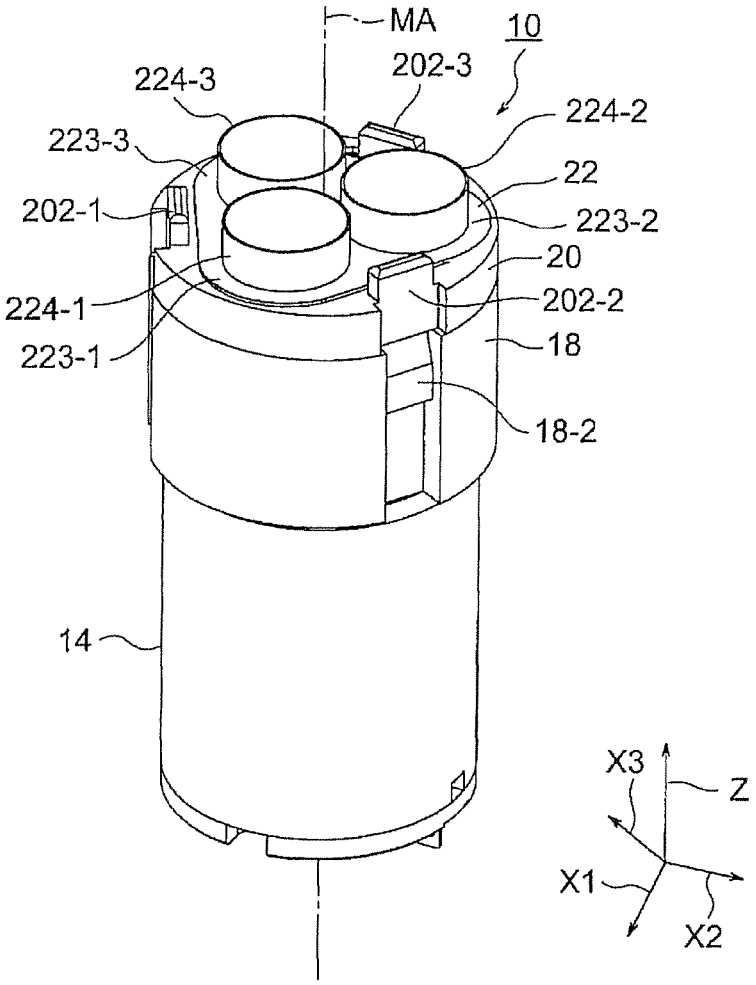
FIG. 4 is a perspective view showing an appearance of the compact pump in a state that an upper cover (discharge cover) is removed from the compact pump as shown in FIG. 1.
Figure 5:
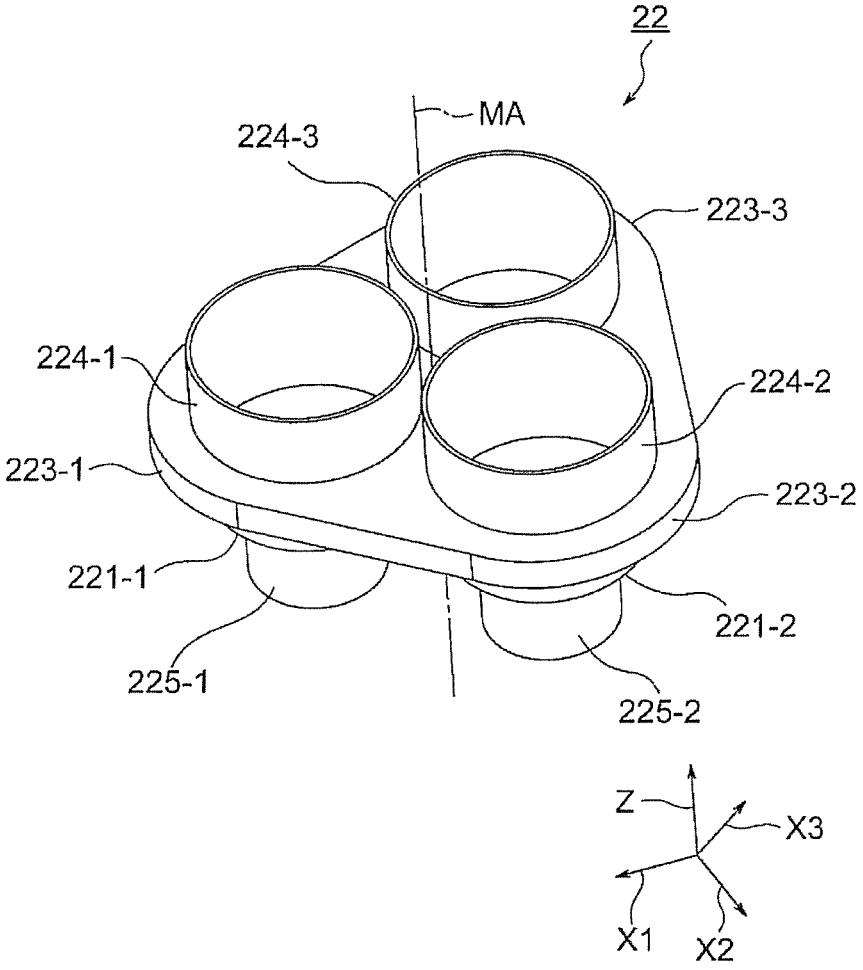
FIG. 5 is a perspective view showing an appearance of a diaphragm assembly that is used in the compact pump as shown in FIG. 1.
Figure 6:
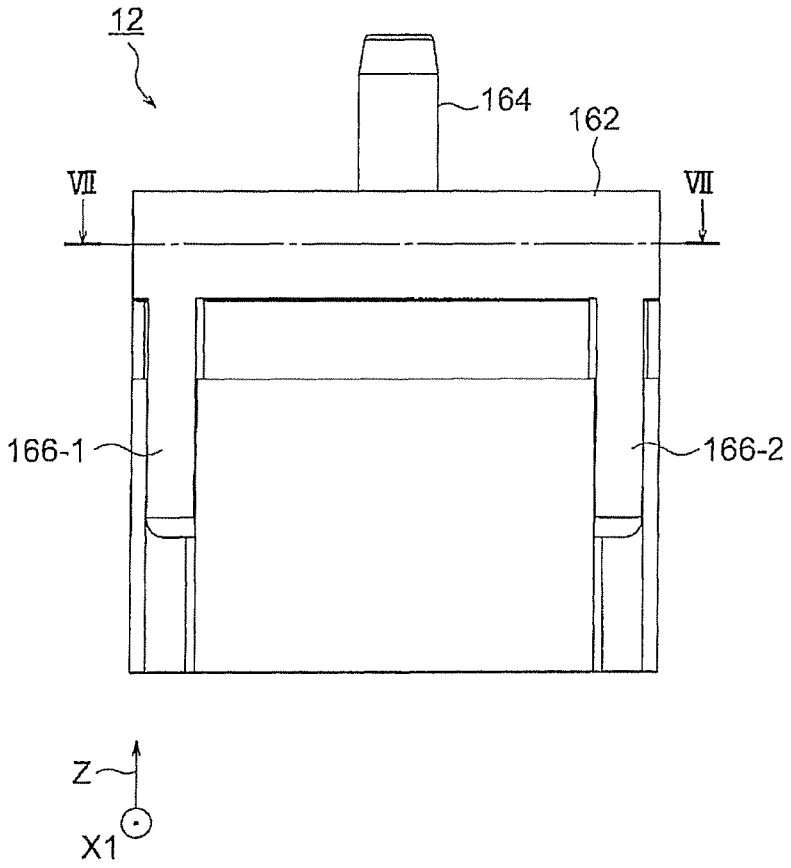
FIG. 6 is a front view of a case of the compact pump shown in FIG. 1.

FIG. 4 is a perspective view showing an appearance of the compact pump 10 in a state that the upper cover (discharge cover) 16 is removed from the compact pump 10 as shown in FIG. 1, and FIG. 5 is a perspective view showing an appearance of the diaphragm assembly 22. FIG. 6 is a front view of the case 12 of the compact pump 10 shown in FIG. 1, and FIG. 7 is a sectional view taken along line VII-VII in FIG. 6.

As shown in FIG. 4, the outside wall of the lower case 18 has first to third hook receiving portions 18-1, 18-2, and 18-3. However, the first and third hook receiving portions 18-1 and 18-3 are omitted in FIG. 4. The first to third hooks 166-1, 166-2, and 166-3 of the upper cover 16 are fitted in the first to third hook receiving portions 18-1, 18-2, and 18-3 of the lower case 18, respectively.

Figure 7:
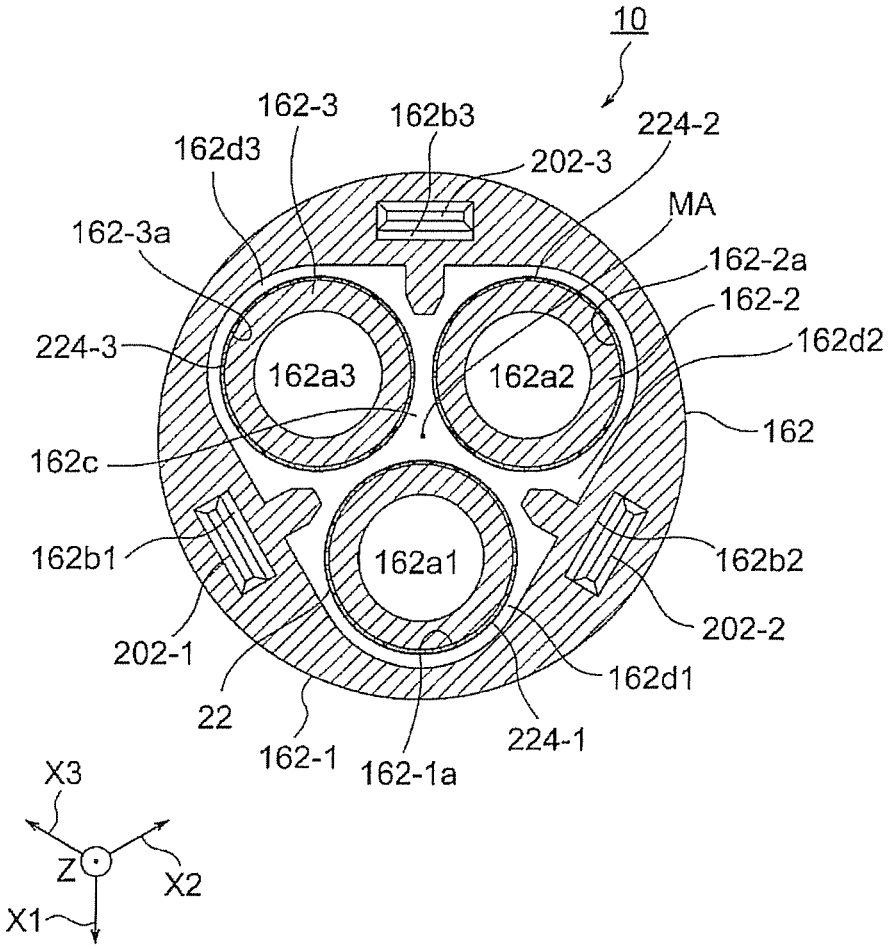
FIG. 7 is a sectional view taken along line VII-VII in FIG. 6.

As shown in FIG. 7, the cover plate 162 of the upper cover 16 has an exhaust hole 162*c* which extends along the motor rotation axis MA and first to third ring-shaped recesses 162*d*1, 162*d*2, and 162*d*3 which are formed around and communicate with the discharge hole 162*c*. The exhaust hole 162*c* communicates with the above-mentioned discharge hole 164*a*. The first to third ring-shaped recesses 162*d*1, 162*d*2, and 162*d*3 are concentric with the first to third cylindrical recesses 162*a*1, 162*a*2, and 162*a*3, respectively. Thus, the first to third ring-shaped recesses 162*d*1, 162*d*2, and 162*d*3 are arranged around the motor rotation axis MA so as to exist in the first to third horizontal directions X1, X2, and X3, respectively. In other words, the first to third ring-shaped recesses 162*d*1, 162*d*2, and 162*d*3 are arranged around the motor rotation axis MA, that is, in the circumferential direction, so as to be spaced from each other by the same angle) (120°).

The cover plate 162 has a first closed-bottom tubular portion 162-1 which is disposed between the first cylindrical recess 162*a*1 and the first ring-shaped recess 162*d*1, a second closed-bottom tubular portion 162-2 which is disposed between the second cylindrical recess 162*a*2 and the second ring-shaped recess 162*d*2, and a third closed-bottom tubular portion 162-3 which is disposed between the third cylindrical recess 162*a*3 and the third ring-shaped recess 162*d*3.

An outer circumferential surface 162-1*a* of the first closed-bottom tubular portion 162-1 serves as a first tubular inner wall surface that defines the first ring-shaped recess 162*d*1. An outer circumferential surface 162-2*a* of the second closed-bottom tubular portion 162-2 serves as a second tubular inner wall surface that defines the second ring-shaped recess 162*d*2. An outer circumferential surface 162-3*a* of the third closed-bottom tubular portion 162-3 serves as a third tubular inner wall surface that defines the third ring-shaped recess 162*d*3.

Referring to FIGS. 4 and 5 in addition to FIG. 2, the diaphragm assembly 22, which is an elastic body made of a synthetic rubber, is disposed in the case 12 at a upper position. The illustrated diaphragm assembly 22 includes first to third diaphragm units 221-1, 221-2, and 22-3 which form first to third pump chambers PC1, PC2, and PC3, respectively. In the illustrated example, the first to third pump chambers PC1, PC2, and PC3 are arranged around the motor rotation axis MA so as to exist in the first to third horizontal directions X1, X2, and X3, respectively. In other words, the first to third pump chambers PC1, PC2, and PC3 are arranged around the motor rotation axis MA, that is, in the circumferential direction, so as to be spaced from each other by the same angle (120°). Thus, the first to third diaphragm units 221-1, 221-2, and 22-3 are also arranged around the motor rotation axis MA so as to exist in the first to third horizontal directions X1, X2, and X3, respectively. In other words, the first to third diaphragm units 221-1, 221-2, and 221-3 are arranged around the motor rotation axis MA, that is, in the circumferential direction, so as to be spaced from each other by the same angle) (120°).

Referring to FIG. 3, the swing body 24 is disposed in a housing space RS of the lower case 18 of the case 12. As described later, the swing body 24 is swung by an eccentric rotary shaft 26 and thereby moves bottom portions of the first to third diaphragm units 221-1, 221-2, and 221-3 in the top-bottom direction in the top-bottom direction.

The swing body 24 is composed of a drive disc 242 having a center opening in which the eccentric rotary shaft 26 is press-fitted and first to third shaft bodies 244-1, 244-2, and 244-3 which project toward the first to third diaphragm units 221-1, 221-2, and 221-3, respectively, at positions in the vicinity of the circumference of the drive disc 242. However, the third shaft body 244-3 is not shown in FIG. 3. The first to third shaft bodies 244-1, 244-2, and 244-3 have first to third air introduction holes 244-1*a*, 244-2*a*, and 244-3*a* (see FIG. 2) at the centers, respectively. However, the third air introduction hole 244-3*a* is not shown in FIG. 3. The first to third air introduction holes 244-1*a*, 244-2*a*, and 244-3*a* communicate with first to third through-holes 222-1*a*, 222-2*a*, and 222-3*a* (see FIG. 2; described later) which are formed at the centers of bottom portions of the first to third diaphragm units 221-1, 221-2, and 221-3, respectively.

As shown in FIG. 2, the first to third diaphragm units 221-1, 221-2, and 221-3 have first to third intake valve elements 222-1, 222-2, and 222-3 which are formed at the centers of their respective bottom portions by cutting away portions of their bottom portions. The cuts formed by cutting away the portions of the bottom portions of the first to third diaphragm units 221-1, 221-2, and 221-3 are parts of the first to third through-holes 222-1*a*, 222-2*a*, and 222-3*a*, respectively.

As shown in FIG. 5, the diaphragm assembly 22 has first to third flanges 223-1, 223-2, and 223-3 which project outward from the top ends of the first to third diaphragm units 221-1, 221-2, and 221-3, respectively. In the illustrated example, the first to third flanges 223-1, 223-2, and 223-3 are integrated together at the center of the diaphragm assembly 22. The diaphragm assembly 22 has first to third tubular exhaust valve elements 224-1, 224-2, and 224-3 extend upward from the first to third flanges 223-1, 223-2, and 223-3 and are thereby connected to the first to third diaphragm units 221-1, 221-2, and 221-3, respectively. In the illustrated example, each of the first to third tubular exhaust valve elements 224-1, 224-2, and 224-3 is shaped like a cylinder.

As shown in FIG. 7, the first to third tubular exhaust valve elements 224-1, 224-2, and 224-3 are inserted in the first to third ring-shaped recesses 162*d*1, 162*d*2, and 162*d*3 in a state that the first to third tubular exhaust valve elements 224-1, 224-2, and 224-3 are in contact with the first to third tubular inner wall surfaces 162-1*a*, 162-2*a*, and 162-3*a*, respectively.

Returning to FIG. 5, the diaphragm assembly 22 further includes first to third hollow attachment bodies 225-1, 225-2, and 225-3 which project from the bottom surfaces of the first to third diaphragm units 221-1, 221-2, and 221-3, respectively. The third hollow attachment body 225-3 is not shown in FIG. 5. In the illustrated example, each of the first to third hollow attachment bodies 225-1, 225-2, and 225-3 is shaped like a cylinder.

As shown in FIG. 3, the first to third hollow attachment bodies 225-1, 225-2, and 225-3 are fitted tightly with the first to third shaft bodies 244-1, 244-2, and 244-3, respectively. The term "fitted tightly" means fitted with no gap.

As a result, the first to third intake valve elements 222-1, 222-2, and 222-3 of the diaphragm assembly 22 can open or close the first to third air introduction holes 244-1*a*, 244-2*a*, and 244-3*a* which are formed through the first to third shaft bodies 244-1, 244-2, and 244-3, respectively.

As shown in FIG. 3, the supporting-point plate 20 supports the diaphragm assembly 22 via the first to third flanges 223-1, 223-2, and 223-3. The bottom surface of the supporting-point plate 20 is formed with a recess 20*a* at the center. A top end portion of the eccentric rotary shaft 26 is fitted loosely in the recess 20*a* of the supporting-point plate 20. The term "fitted loosely" means fitted with play. A bottom end portion of the eccentric rotary shaft 26 is fastened to a rotary body 28 at an off-center position. The rotary body 28 is rotated by a rotary drive shaft 30 of the motor 14.

Thus, when the rotary drive shaft 30 of the motor 14 is rotated about the motor rotation axis MA, the rotary body 28 is also rotated about the motor rotation axis MA. As the rotary body 28 is rotated, the eccentric rotary shaft 26 is rotated in an eccentric manner with its top-end loosely fitted portion as a supporting point. The swing body 24 is swung by the eccentric rotation of the eccentric rotary shaft 26. The combination of the motor 14, the rotary drive shaft 30, the rotary body 28, and the eccentric rotary shaft 26 serves as a swing drive means (14, 30, 28, 26) which swing-drives the swing body 24.

Figure 8:
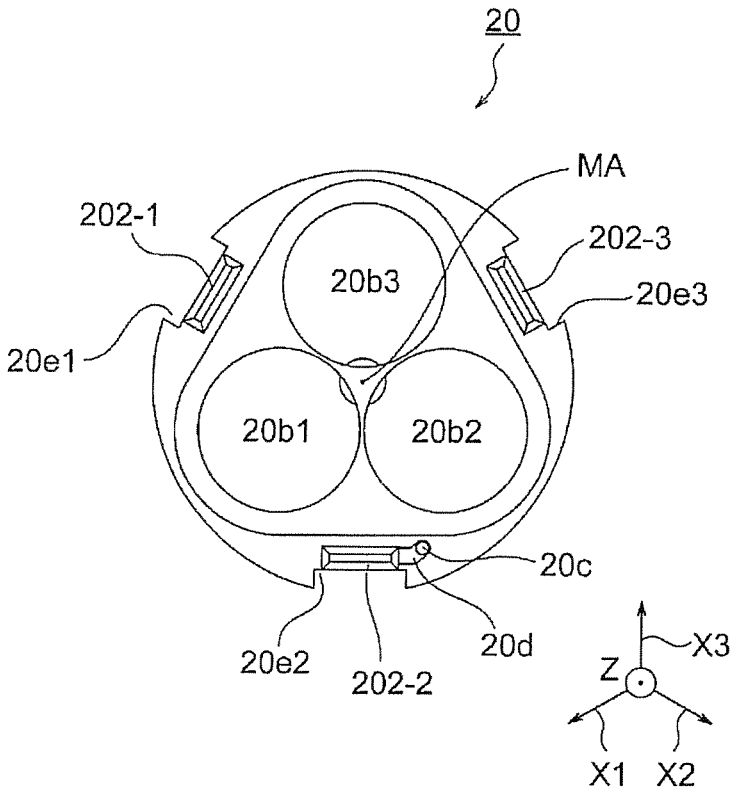
FIG. 8 is a plan view of a supporting-point plate used in the compact pump shown in FIG. 1.

FIG. 8 is a plan view of the supporting-point plate 20. The supporting-point plate 20 has first to third circular openings 20*b*1, 20*b*2, and 20*b*3 which are arranged around the motor rotation axis MA so as to exist in the first to third horizontal directions X1, X2, and X3, respectively. The first to third diaphragm units 221-1, 221-2, and 221-3 of the diaphragm assembly 22 penetrate through the first to third circular openings 20*b*1, 20*b*2, and 20*b*3, respectively.

The supporting-point plate 20 has first to third plunging pins 202-1, 202-2, and 202-3 which project upward into the first to third hook formation rectangular holes 162*b*1, 162*b*2, and 162*b*3 with gaps so as to be in contact with the inner wall surfaces of the first to third hooks 166-1, 166-2, and 166-3 of the upper cover 16, respectively.

The supporting-point plate 20 has one intake hole 20*c* for sucking air from outside the case 12 into the housing space RS of the lower case 18. In the illustrated example, the intake hole 20*c* is formed close to the second plunging pin 202-2 and is 0.8 mm in diameter. The supporting-point plate 20 also has one bypass passage 20*d* which provides a bypass route for allowing the above-mentioned gap in the second hook formation rectangular hole 162*b*2 and the intake hole 20*c* to communicate with each other.

The supporting-point plate 20 has first to third rectangular grooves 20*e*1, 20*e*2, and 20*e*3 which are formed close to the first to third plunging pins 202-1, 202-2, and 202-3 and allow the first to third hooks 166-1, 166-2, and 166-3 to pass through themselves, respectively.

Figure 9:
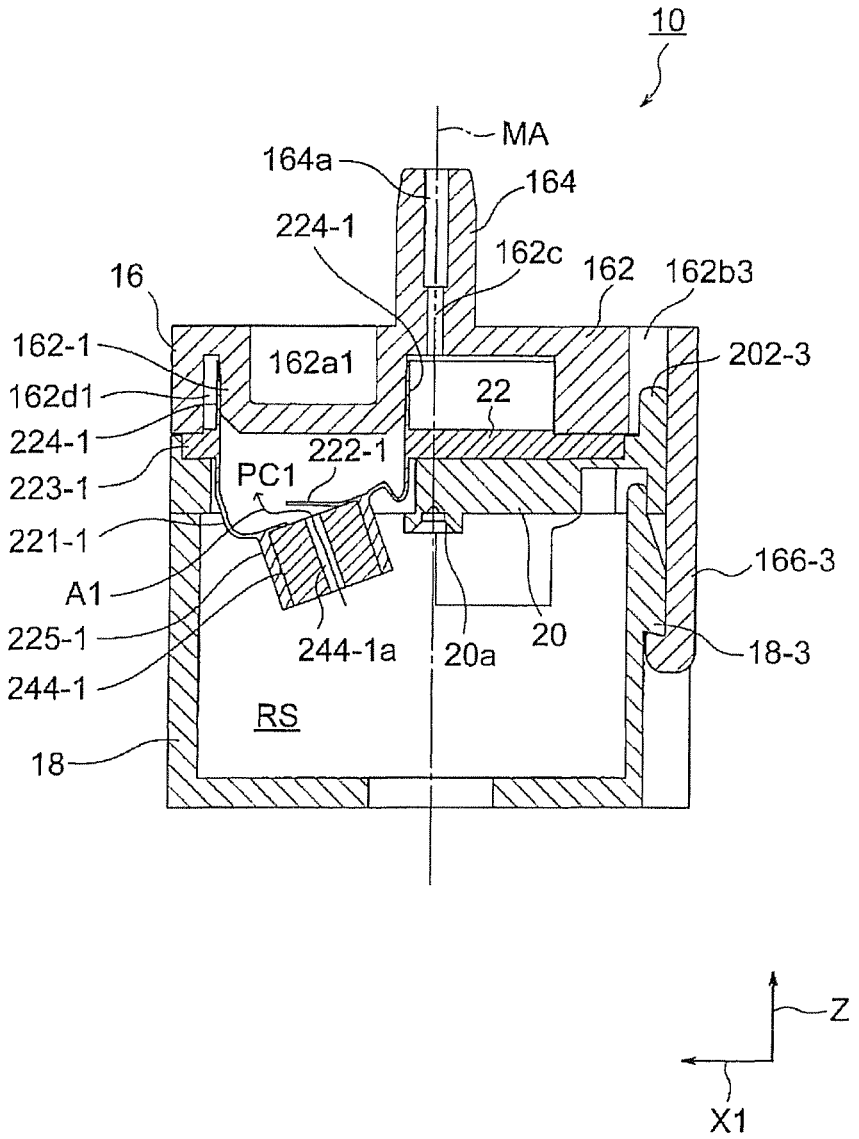
FIG. 9 is a vertical sectional view obtained by cutting the compact pump shown in FIG. 1 by a plane that includes a motor rotation axis and a first horizontal direction, and illustrates how the small motor operates.
Figure 10:
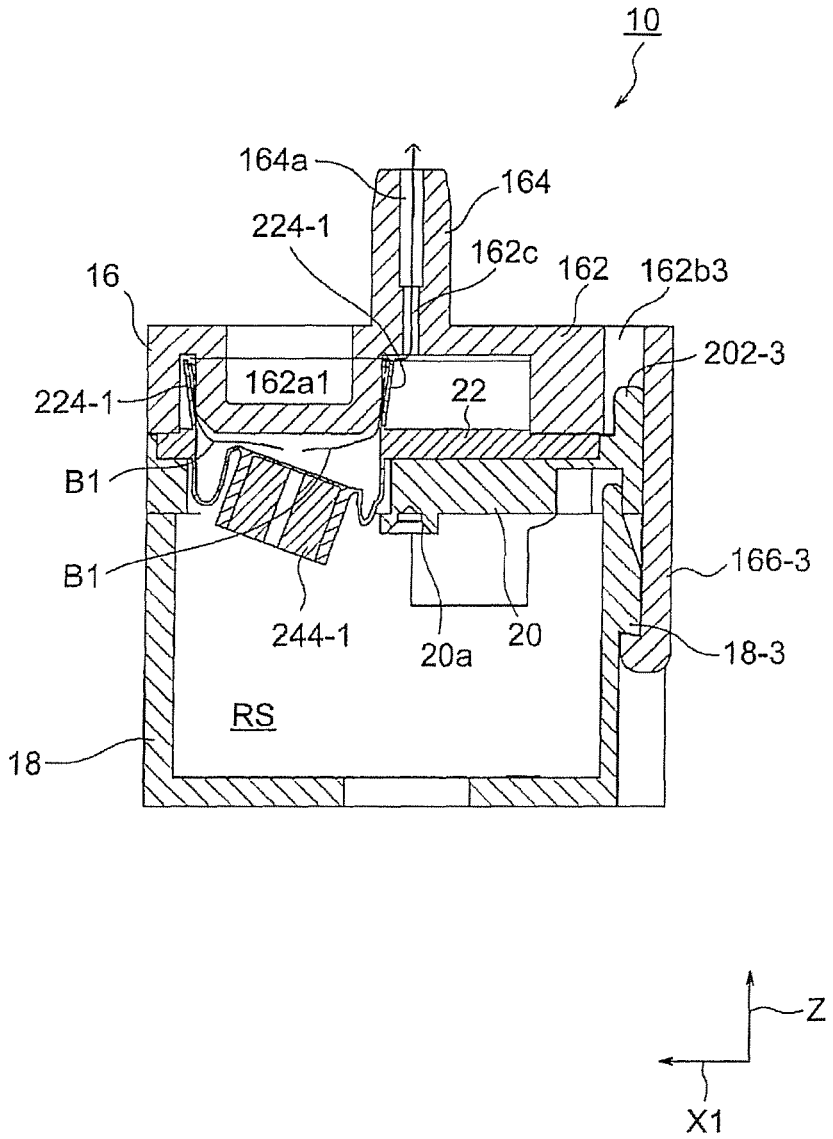
FIG. 10 is another vertical sectional view obtained by cutting the compact pump shown in FIG. 1 by the plane that includes the motor rotation axis and the first horizontal direction, and illustrates how the small motor operates.

Next, how the compact pump 10 of the related technique operates will be described with reference to FIGS. 9 and 10. FIGS. 9 and 10 are vertical sectional views obtained by cutting the compact pump 10 shown in FIG. 1 by a plane that includes the motor rotation axis MA and the first horizontal direction X1. However, the swing drive means (14, 30, 28, 26) and the drive disc 242 of the swing body 24 are omitted in FIGS. 9 and 10. FIG. 9 shows a state that the bottom end portion of the first diaphragm unit 221-1 is moved down by the swing body 24, and FIG. 10 shows a state that the bottom end portion of the first diaphragm unit 221-1 is moved up by the swing body 24.

First, as shown in FIG. 9, assume that the bottom portion of the first diaphragm unit 221-1 has been moved down. At this time, a negative pressure occurs in the first pump chamber PC1 of the first diaphragm unit 221-1. As a result, the first tubular exhaust valve element 224-1 comes into close contact with the first tubular inner wall surface 162-1*a* of the first ring-shaped recess 162*d*1 to close the exhaust hole 162*c*. At the same time, the first intake valve element 222-1 opens the first air introduction hole 244-1*a* being closed. As a result, as indicated by arrow A1 in FIG. 9, air is sucked into the first pump chamber PC1 of the first diaphragm unit 221-1 through the first air introduction hole 244-1*a*. Air outside the case 12 is sucked into the housing space RS of the lower case 18 through the intake hole 20*c* of the supporting-point plate 20.

Next, as shown in FIG. 10, assume that the bottom portion of the first diaphragm unit 221-1 has been moved up. At this time, a high pressure occurs in the first pump chamber PC1 of the first diaphragm unit 221-1. As a result, the first intake valve element 222-1 closes the first air introduction hole 244-1*a*. At the same time, the first tubular exhaust valve element 224-1 becomes wider than the first tubular inner wall surface 162-1*a*. As a result, as indicated by arrow B1 in FIG. 10, air is discharged from the first pump chamber PC1 of the first diaphragm unit 221-1 to outside the case 12 through the gap between the first tubular exhaust valve element 224-1 and the first tubular inner wall surface 162-1*a*, the exhaust hole 162*c*, and the discharge hole 164*a*. More specifically, the air that has been discharged to outside the case 12 goes through an air tube (not shown) attached to the discharge pipe 164 and is supplied to a blood pressure monitor that is connected to the air tube.

At this time, the gap is formed uniformly between the first tubular exhaust valve element 224-1 and the first tubular inner wall surface 162-1*a*, not only in a region that is distant from the motor rotation axis MA but also in a region close to the motor rotation axis MA (i.e., a region close to the exhaust hole 162*c*).

As described above, in the compact pump 10 of the related technique, the first, second, or third tubular exhaust valve element 224-1, 224-2, or 224-3 becomes wider than the first, second, or third tubular inner wall surface 162-1*a*, 162-2*a*, or 162-3*a* every time an exhaust action is done. In other words, every time an exhaust action is done, the first, second, or third tubular exhaust valve element 224-1, 224-2, or 224-3 hits the first, second, or third tubular inner wall surface 162-1*a*, 162-2*a*, or 162-3*a*. Because of such hitting actions, operating sounds of the first to third tubular exhaust valve elements 224-1, 224-2, and 224-3 are output to outside the case 12 through the exhaust hole 162*c* and the discharge hole 164*a* as they are, that is, without being attenuated inside the compact pump 10. As such, the compact pump 10 of the related technique has a problem that such operating sounds become noise sounds (noise).

DETAILED DESCRIPTION OF THE INVENTION

The configuration of a compact pump 10A according to a first embodiment of the invention will be described with reference to FIGS. 11-15.

Figure 11:
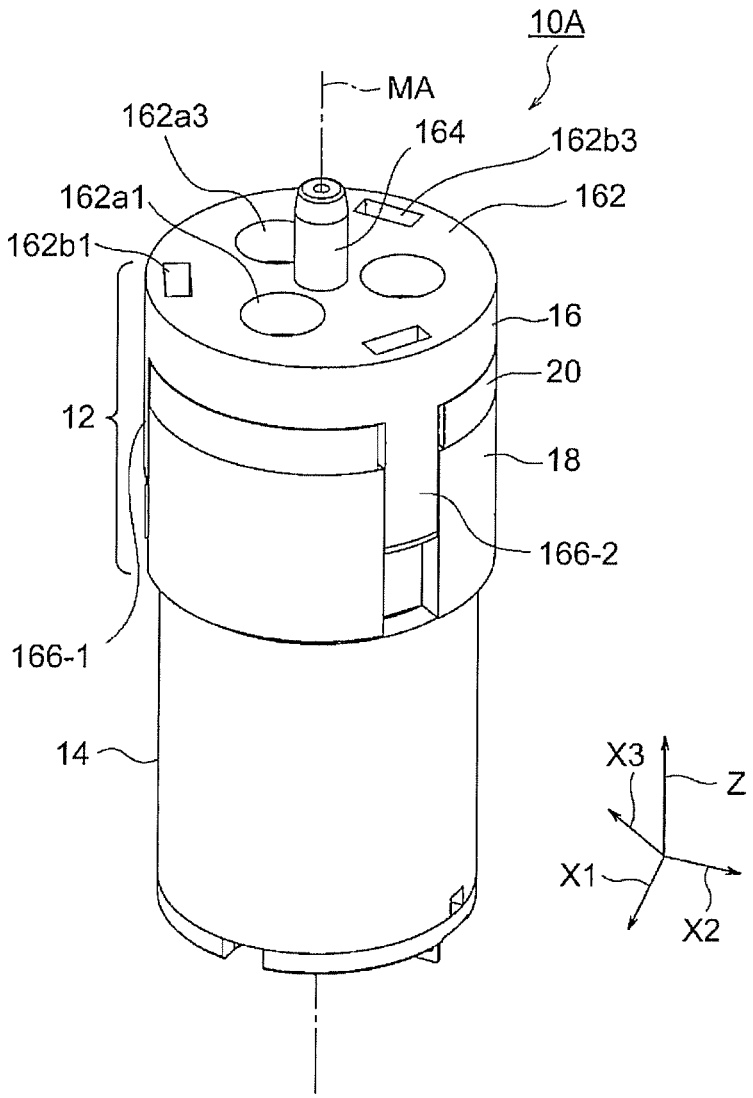
FIG. 11 is a perspective view showing an appearance of a compact pump according to a first embodiment of the present invention.
Figure 12:
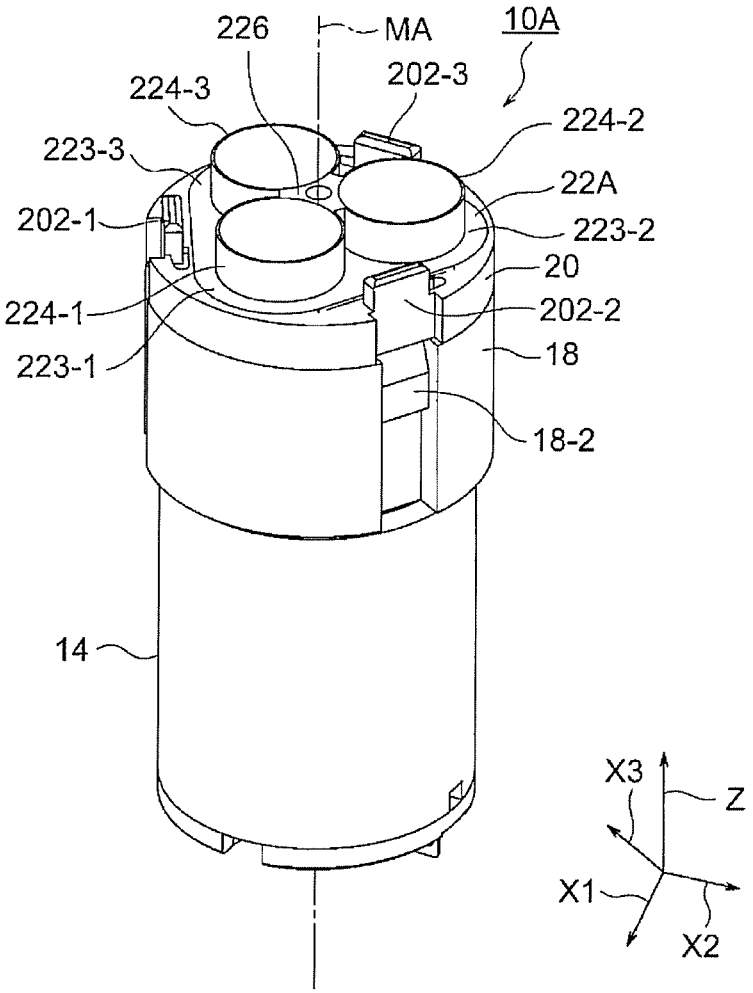
FIG. 12 is a perspective view showing an appearance of the compact pump in a state that an upper cover (discharge cover) is removed from the compact pump as shown in FIG. 11.

FIG. 11 is a perspective view showing an appearance of the compact pump 10A. FIG. 12 is a perspective view showing an appearance of the compact pump 10A in a state that the upper cover (discharge cover) 16 is removed from the compact pump 10 as shown in FIG. 11.

The following description will employ a coordinate system (X1, X2, X3, Z) shown in FIGS. 11 and 12. In the state shown in FIGS. 11 and 12, in the coordinate system (X1, X2, X3, Z), the Z direction is the top-bottom direction (vertical direction) in which the motor rotation axis MA extends and the X1, X2, and X3 directions are first to third horizontal directions, respectively, that deviate from each other by the same angle (120°) around the motor rotation axis MA (Z direction) in a plane that is perpendicular to the motor rotation axis MA (Z direction).

The illustrated compact pump 10A has the same configuration and operates in the same manner as the above-described compact pump 10 of the related technique except differences, described below, in the diaphragm assembly. Thus, the diaphragm assembly of the former is given a reference symbol 22A. Constituent elements of the compact pump 10A having the same functions as the corresponding ones of the compact pump 10 shown in FIGS. 1-4 are given the same reference symbols as the latter. In the following, to simplify the description, only differences from the compact pump 10 of the related technique will be described in detail.

Figure 13:
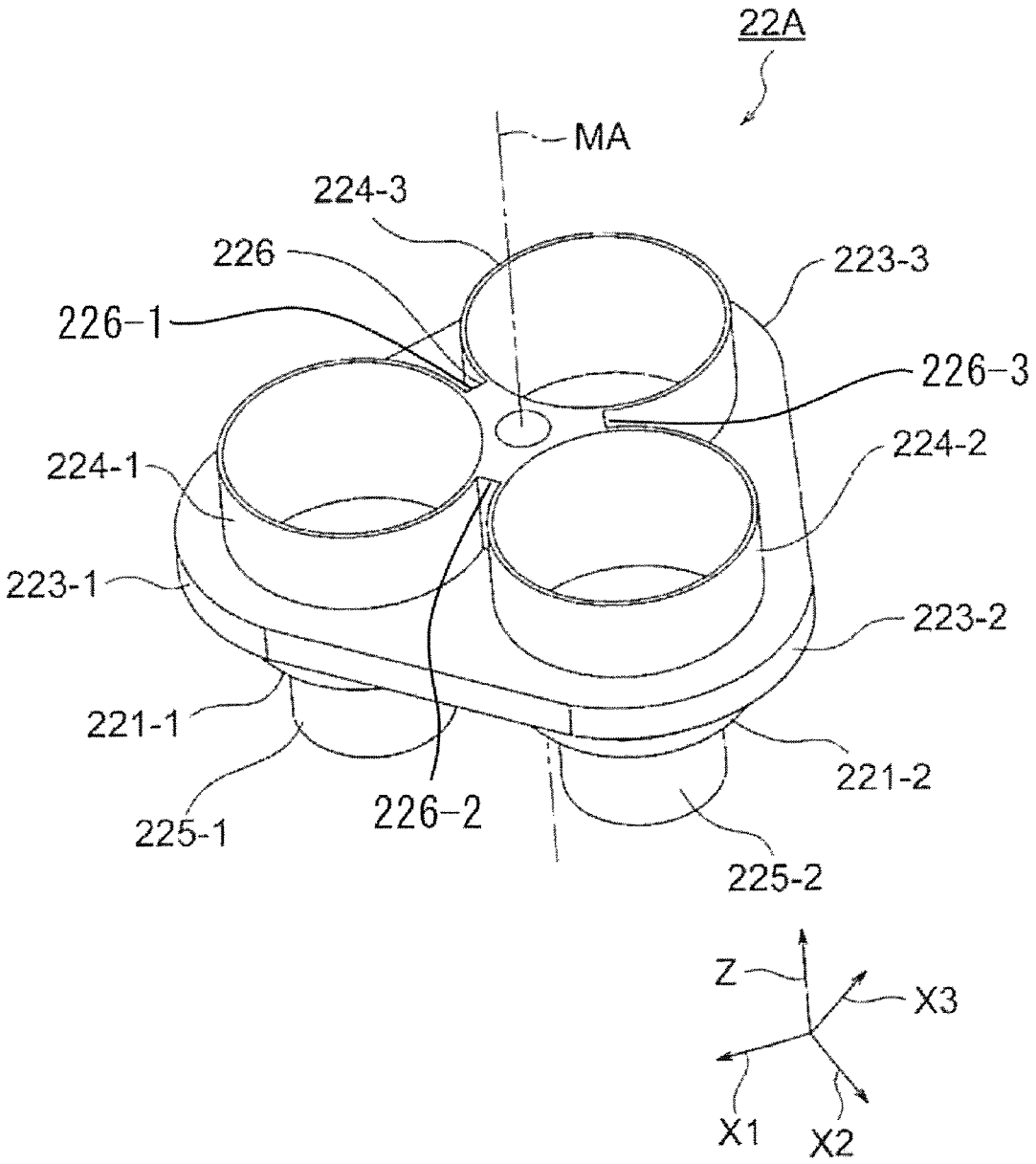
FIG. 13 is a perspective view showing an appearance of a diaphragm assembly that is used in the compact pump as shown in FIG. 1.
Figure 14:
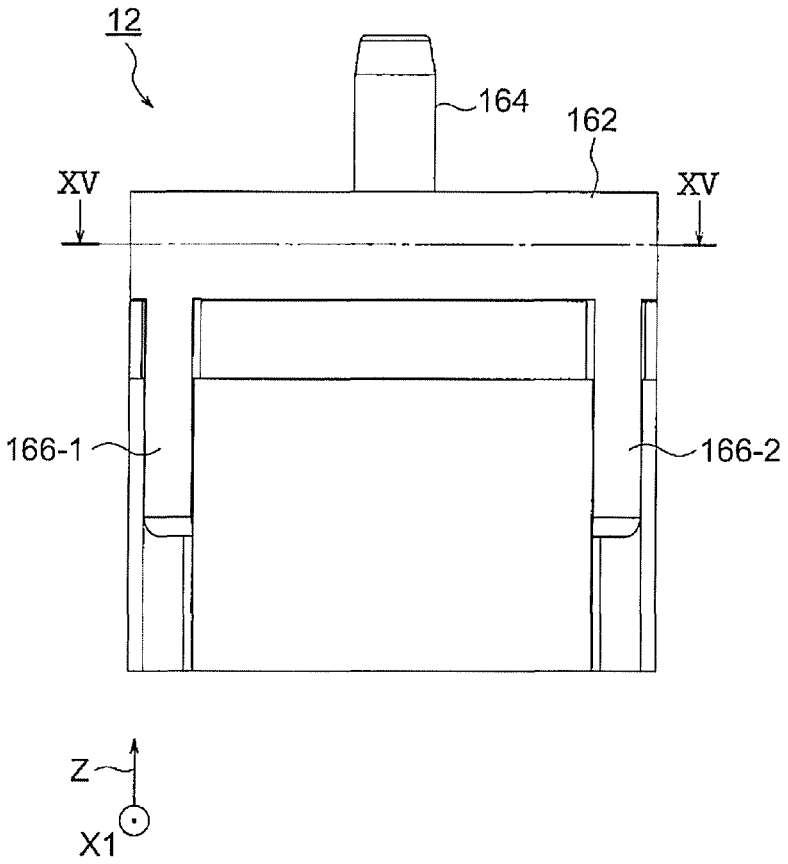
FIG. 14 is a front view of the case of the compact pump shown in FIG. 11.
Figure 15:
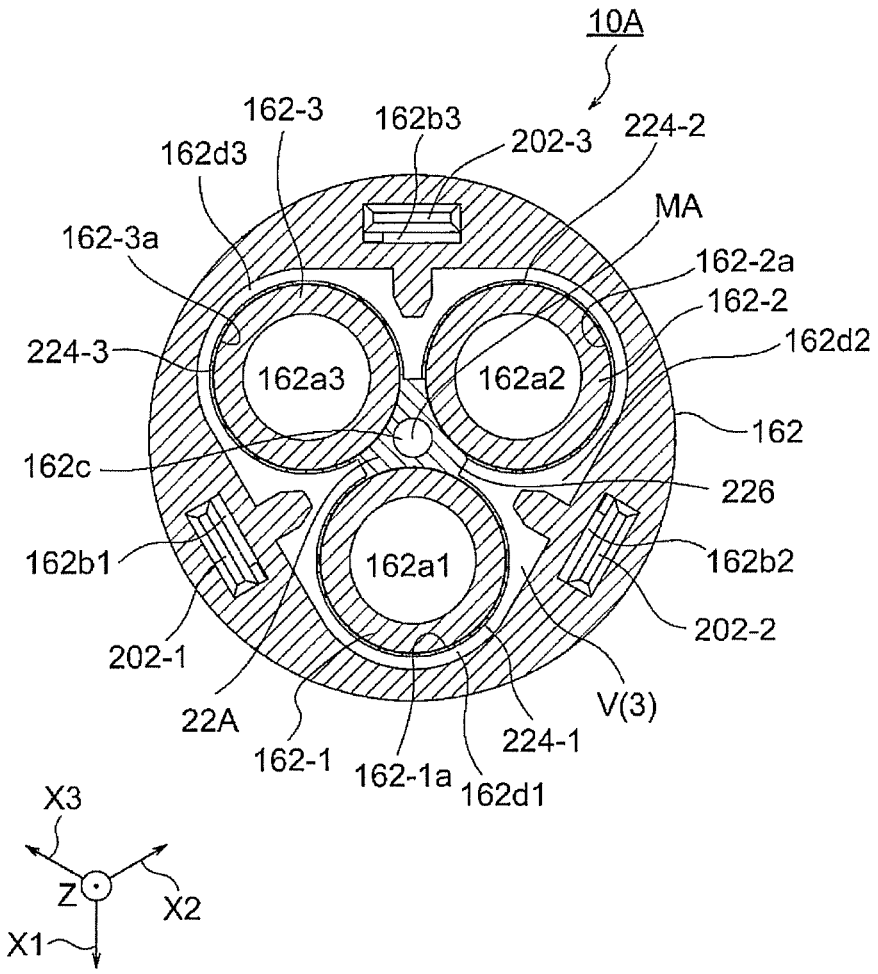
FIG. 15 is a sectional view taken along line XV-XV in FIG. 14.

FIG. 13 is a perspective view showing an appearance of the diaphragm assembly 22A. FIG. 14 is a front view of the case 12 of the compact pump 10A shown in FIG. 11, and FIG. 15 is a sectional view taken along line XV-XV in FIG. 14.

As shown in FIG. 13, the diaphragm assembly 22A is the same in structure as the diaphragm assembly 22 shown in FIG. 5 except that the former has a rib 226 (described later).

The rib 226 is disposed at the center of the diaphragm assembly 22A in the vicinity of the exhaust hole 162*c* (see FIG. 3), and connects the first to third tubular exhaust valve elements 224-1, 224-2, and 224-3.

The rib 226 thus provided can control operations of the first to third tubular exhaust valve elements 224-1, 224-2, and 224-3 during exhaust actions. In other words, by causing the first to third tubular exhaust valve elements 224-1, 224-2, and 224-3 act in regions that are distant from the exhaust hole 162*c*, the rib 226 makes it possible to attenuate operating sounds of the first to third tubular exhaust valve elements 224-1, 224-2, and 224-3 in the inside spaces of the first to third ring-shaped recesses 162*d*1, 162*d*2, and 162*d*3. As a result, the level of noise sounds that are output to outside the case 12 through the exhaust hole 162*c* can be lowered.

As shown in FIG. 15, the rib 226 serves as a partition among the first to third ring-shaped recesses 162*d*1, 162*d*2, and 162*d*3.

The above structure makes it possible to cause operating sounds of the first to third tubular exhaust valve elements 224-1, 224-2, and 224-3 to be reflected and attenuated in the narrow spaces, to enhance the sound attenuation effect further.

Figure 16:
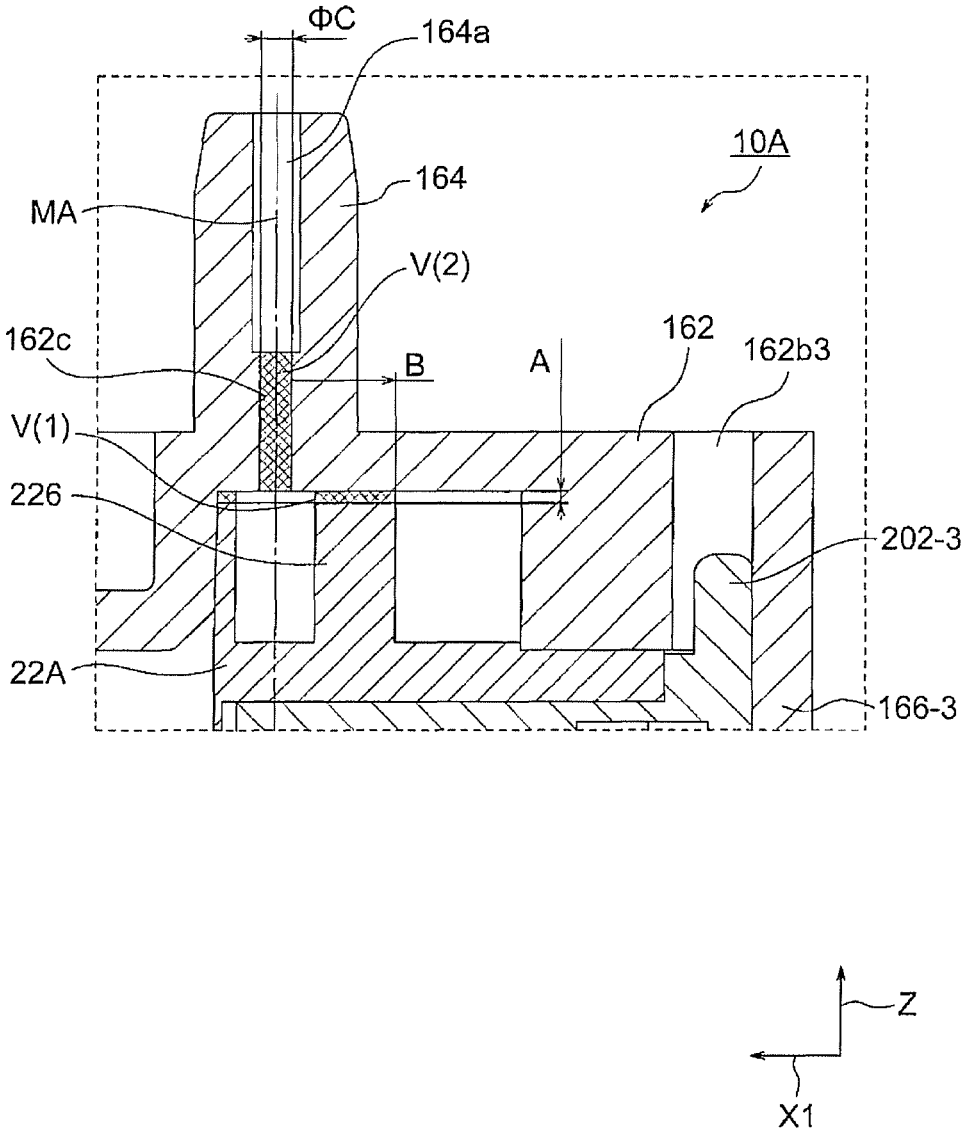
FIG. 16 is an enlarged vertical sectional view of an exhaust portion of the compact pump shown in FIG. 11.

FIG. 16 is an enlarged sectional view of an exhaust portion of the compact pump 10A shown in FIG. 11. In FIG. 16, symbol ϕC represents the diameter of the exhaust hole 162*c*.

As shown in FIG. 16, the distance between the top surface of the rib 226 and the ceiling surface of the upper cover 16 is represented by A. The volume of the space between the top surface of the rib 226 and the ceiling surface of the upper cover 16 is represented by V(1), and the volume of the exhaust hole 162*c* is represented by V(2). And the volume of the first to third ring-shaped recesses 162*d*1, 162*d*2, and 162*d*3 is represented by V(3) (see FIG. 15). With this notation, the distance A is set in a range that the volume V(1) is larger than the volume V(2) and smaller than the volume V(3). And it is preferable that the distance A be set at such a minimum distance that the volume V(1) is substantially equal to the volume V(2).

By employing the above structure, a pressure variation that air experiences until reaching the exhaust hole 162*c* can be made smooth without the flow rate of air that is discharged from the first, second, or third pump chamber PC1, PC2, or PC3 of the first, second, or third diaphragm unit 221-1, 221-2, or 221-3 is lowered. This enhances the sound attenuation effect further.

Figure 17:
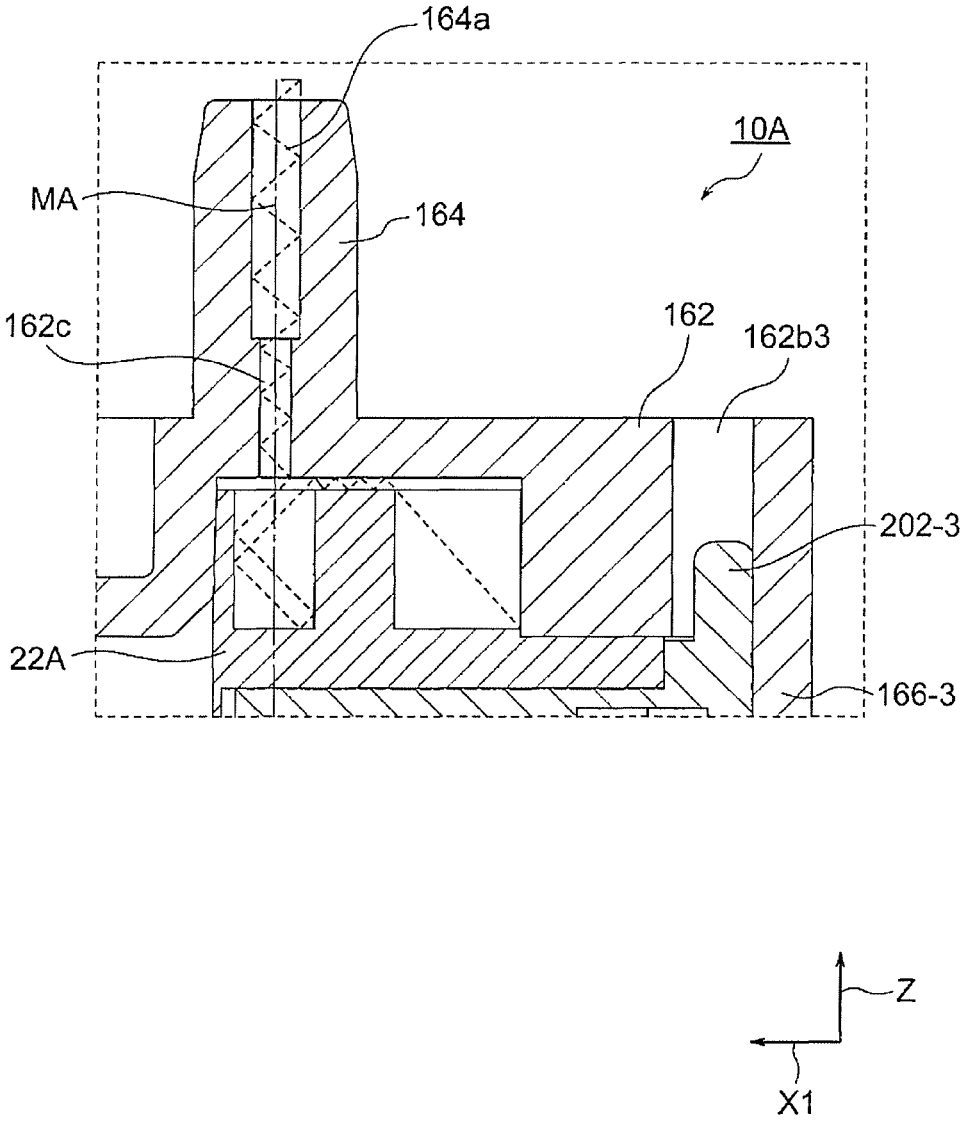
FIG. 17 is an enlarged vertical sectional view of the exhaust portion of the compact pump shown in FIG. 11 and illustrates, as an image, how reflection sounds of operating sounds of the first to third tubular exhaust valve elements travel.

FIG. 17 is an enlarged vertical sectional view of the exhaust portion of the compact pump 10A shown in FIG. 11 and illustrates, as an image, how reflection sounds of operating sounds of the first to third tubular exhaust valve elements 224-1, 224-2, and 224-3 travel. The image of the traveling reflection sounds is indicated by a broken-line arrow in FIG. 17.

As shown in FIG. 16, the distance between the motor rotation axis MA and the outer circumferential wall surfaces is represented by B. As shown in FIG. 17, the distance B is set at such a value that the exhaust hole 162*c* is not seen directly when the top edge of the rib 226 is viewed from the outside edge of the diaphragm assembly 22A in the radial direction.

The employment of this structure makes it possible to prevent reflection sounds of operating sounds of the first to third tubular exhaust valve elements 224-1, 224-2, and 224-3 that exist in the first to third ring-shaped recesses 162*d*1, 162*d*2, and 162*d*3 directly reach the exhaust hole 162*c*. This enhances the sound attenuation effect further.

Figure 18:
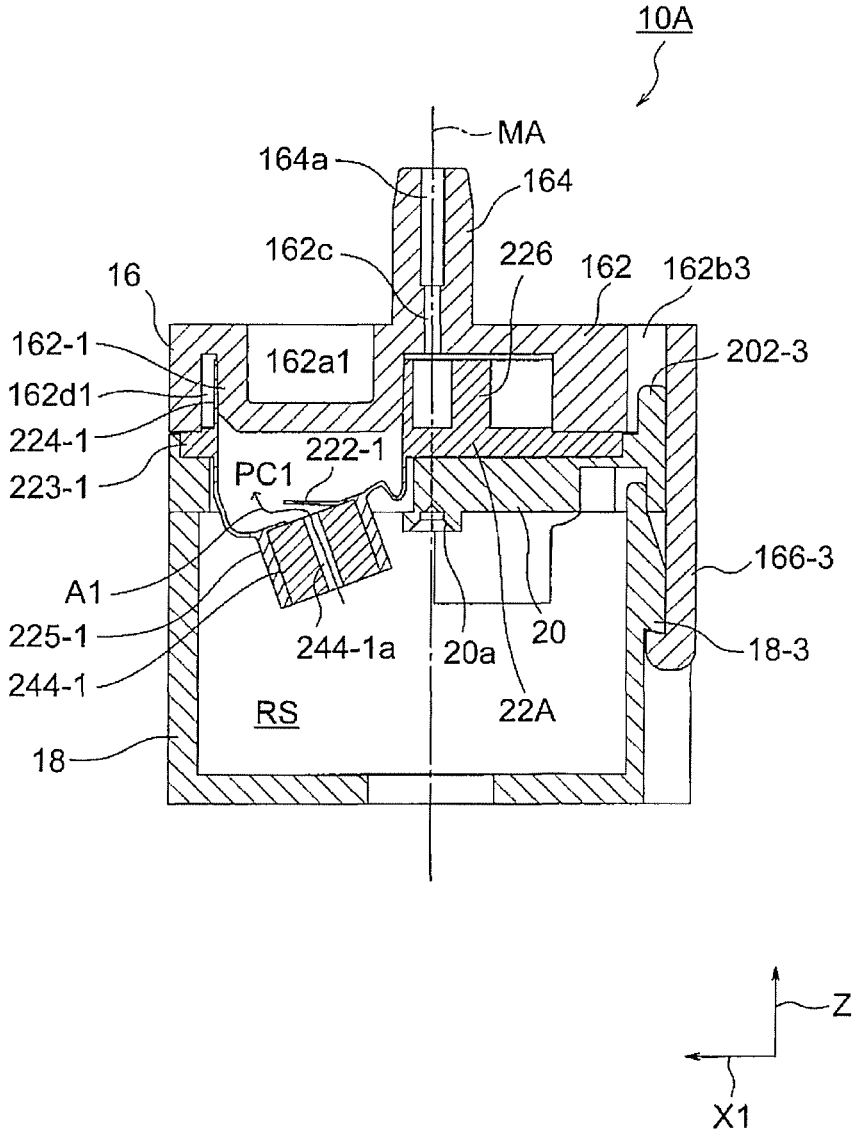
FIG. 18 is a vertical sectional view obtained by cutting the compact pump shown in FIG. 11 by a plane that includes the motor rotation axis and the first horizontal direction, and illustrates how the small motor operates.
Figure 19:
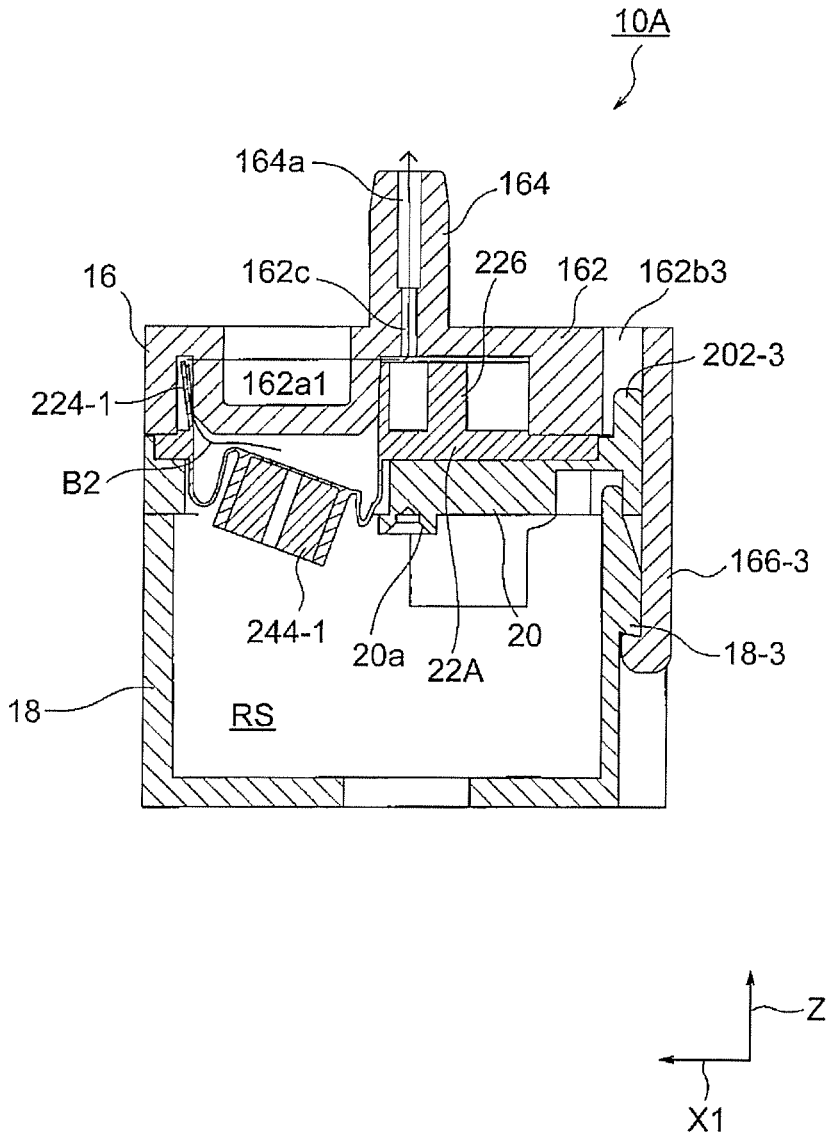
FIG. 19 is another vertical sectional view obtained by cutting the compact pump shown in FIG. 11 by the plane that includes the motor rotation axis and the first horizontal direction, and illustrates how the small motor operates.

Next, how the compact pump 10A according to the first embodiment operates will be described with reference to FIGS. 18 and 19. FIGS. 18 and 19 are vertical sectional views obtained by cutting the compact pump 10A shown in FIG. 11 by a plane that includes the motor rotation axis MA and the first horizontal direction X1. However, the swing drive means (14, 30, 28, 26) and the drive disc 242 of the swing body 24 are omitted in FIGS. 18 and 19. FIG. 18 shows a state that the bottom end portion of the first diaphragm unit 221-1 is moved down by the swing body 24, and FIG. 19 shows a state that the bottom end portion of the first diaphragm unit 221-1 is moved up by the swing body 24.

First, as shown in FIG. 18, assume that the bottom portion of the first diaphragm unit 221-1 has been moved down. At this time, a negative pressure occurs in the first pump chamber PC1 of the first diaphragm unit 221-1. As a result, the first tubular exhaust valve element 224-1 comes into close contact with the first tubular inner wall surface 162-1*a* of the first ring-shaped recess 162*d*1 to close the exhaust hole 162*c*. At the same time, the first intake valve element 222-1 opens the first air introduction hole 244-1*a* being closed. As a result, as indicated by arrow A1 in FIG. 18, air is sucked into the first pump chamber PC1 of the first diaphragm unit 221-1 through the first air introduction hole 244-1*a*. Air outside the case 12 is sucked into the housing space RS of the lower case 18 through the intake hole 20*c* of the supporting-point plate 20.

Next, as shown in FIG. 19, assume that the bottom portion of the first diaphragm unit 221-1 has been moved up. At this time, a high pressure occurs in the first pump chamber PC1 of the first diaphragm unit 221-1. As a result, the first intake valve element 222-1 closes the first air introduction hole 244-1*a*. At the same time, the first tubular exhaust valve element 224-1 is forced to become wider than the first tubular inner wall surface 162-1*a*. However, since the diaphragm assembly 22A has the rib 226 at the center, the first tubular exhaust valve element 224-1 is not increased in width near the motor rotation axis MA. As a result, as indicated by arrow B2 in FIG. 19, air is discharged from the first pump chamber PC1 of the first diaphragm unit 221-1 to outside the case 12 through the gap that is formed between the first tubular exhaust valve element 224-1 and the first tubular inner wall surface 162-1*a* in the region excluding the central region, the exhaust hole 162*c*, and the discharge hole 164*a*.

In the first embodiment, the gap that is formed between the first tubular exhaust valve element 224-1 and the first tubular inner wall surface 162-1*a* is formed only in the region that is distant from the motor rotation axis MA.

As described above, in the compact pump 10A according to the first embodiment, the first, second, or third tubular exhaust valve element 224-1, 224-2, or 224-3 becomes wider than the first, second, or third tubular inner wall surface 162-1*a*, 162-2*a*, or 162-3*a* in the region excluding the central region every time an exhaust action is done. In other words, every time an exhaust action is done, the first, second, or third tubular exhaust valve element 224-1, 224-2, or 224-3 hits the first, second, or third tubular inner wall surface 162-1*a*, 162-2*a*, or 162-3*a* in the region excluding the central region. Because of such hitting actions, operating sounds of the first to third tubular exhaust valve elements 224-1, 224-2, and 224-3 are output to outside the case 12 through the exhaust hole 162*c* and the discharge hole 164*a* after being attenuated inside the compact pump 10A. As such, in the compact pump 10A of the first embodiment, the level of noise sounds (noise) of such operating sounds can be lowered.

Figure 20:
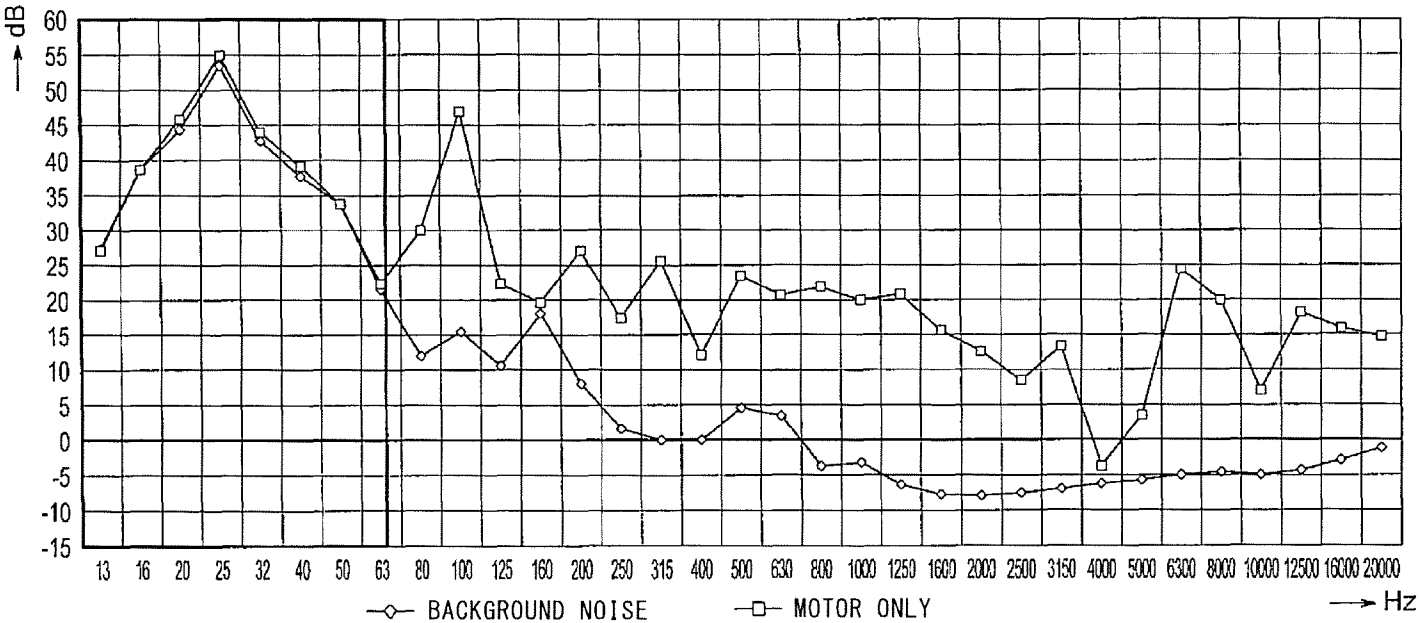
FIG. 20 is a graph showing frequency characteristics of background noise and a noise sound of the motor itself.
Figure 21:
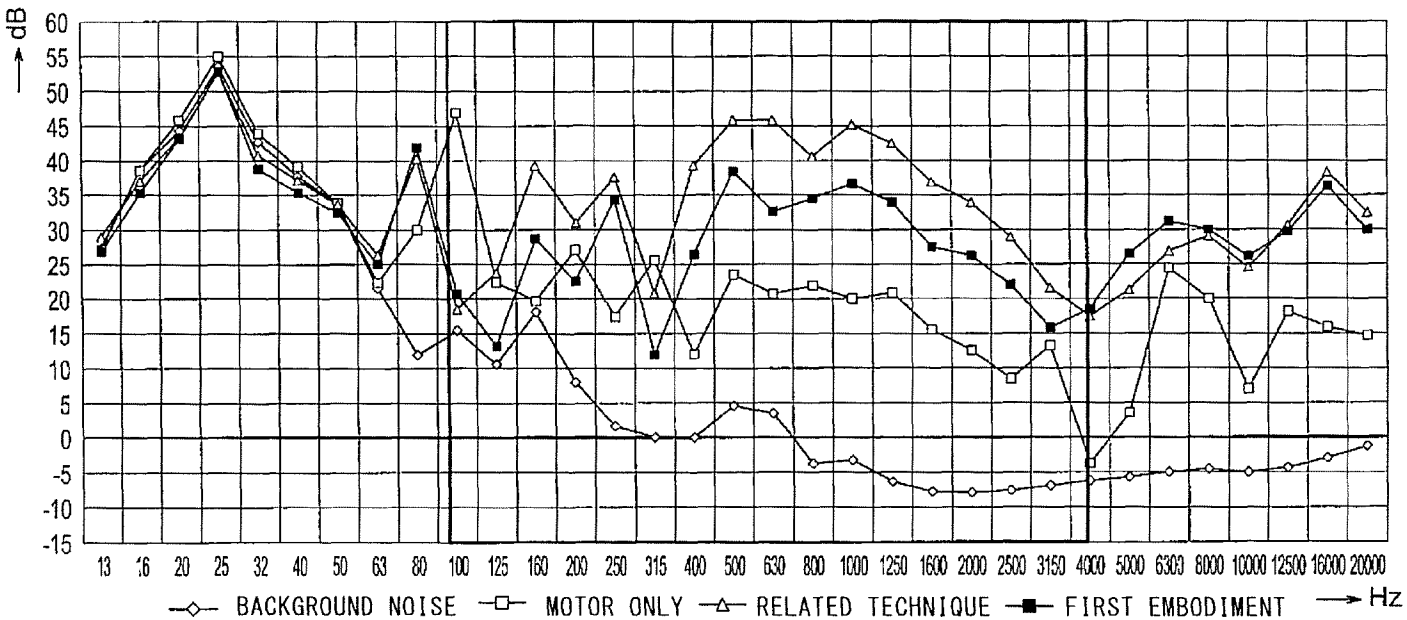
FIG. 21 is a graph showing frequency characteristics of the background noise, a noise sound of the motor itself, noise sounds of the compact pump of the related technique, and noise sounds of the compact pump according to the first embodiment.

Next, the noise sounds weakening effect of the compact pump 10 of the related technique shown in FIGS. 1-10 and that of the compact pump 10A according to the first embodiment shown in FIGS. 11-19 will be compared with each other with reference to FIGS. 20 and 21.

FIG. 20 is a graph showing frequency characteristics of background noise and a noise sound of the motor 14 itself. In FIG. 20, the horizontal axis represents the frequency (Hz) and the vertical axis represents the noise level (dB). The term "background noise" means noise occurring in an environment of target noise, that is, total noise other than the target noise.

As seen from FIG. 20, the noise level of the motor 14 itself is substantially the same as that of the background noise in a frequency range of 12.5 to 63 Hz. In a frequency range that is higher than or equal to 63 Hz, the noise level of the motor 14 itself is higher than that of the background noise.

FIG. 21 is a graph showing frequency characteristics of the background noise, a noise sound of the motor 14 itself, noise sounds of the compact pump 10 of the related technique, and noise sounds of the compact pump 10A according to the first embodiment. In FIG. 20, the horizontal axis represents the frequency (Hz) and the vertical axis represents the noise level (dB).

It is seen from FIG. 21 that the noise level of the compact pump 10A according to the first embodiment is lower than that of the compact pump 10 of the related technique in a frequency range of 100 Hz to 4 kHz. However, it is seen that the noise level of the compact pump 10A according to the first embodiment is substantially the same as that of the compact pump 10 of the related technique in a frequency range of 4 to 20 kHz. This seems to be due to influence of intake sounds.

As is apparent from the above description, since the diaphragm assembly 22A has the rib 226, the compact pump 10A according to the first embodiment of the invention provides an advantage that noise sounds can be weakened without increasing the number of components.

Embodiment 2

The configuration of a compact pump 10B according to a second embodiment of the invention will be described with reference to FIGS. 22-25.

Figure 22:
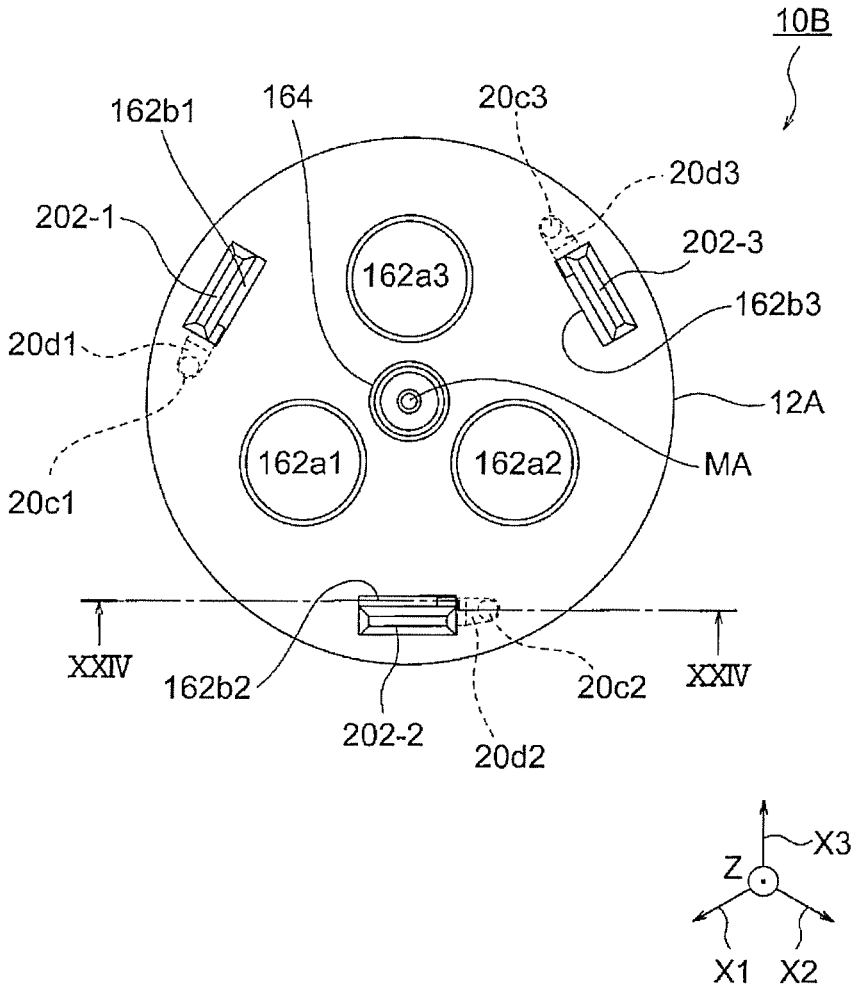
FIG. 22 is a plan view of a compact pump according to a second embodiment of the invention.

FIG. 22 is a plan view of the compact pump 10B.

The following description will employ a coordinate system (X1, X2, X3, Z) shown in FIG. 22. In the state shown in FIG. 22, in the coordinate system (X1, X2, X3, Z), the Z direction is the top-bottom direction (vertical direction) in which the motor rotation axis MA extends and the X1, X2, and X3 directions are first to third horizontal directions, respectively, that deviate from each other by the same angle) (120°) around the motor rotation axis MA (Z direction) in a plane that is perpendicular to the motor rotation axis MA (Z direction).

The illustrated compact pump 10B has the same configuration and operates in the same manner as the above-described compact pump 10A according to the first embodiment except differences, described below, in the supporting-point plate. Thus, the case and the supporting-point plate of the former are given reference symbols 12A and 20A, respectively. Constituent elements of the compact pump 10B having the same functions as the corresponding ones of the compact pump 10A shown in FIGS. 11-15 are given the same reference symbols as the latter. In the following, to simplify the description, only differences from the compact pump 10A according to the first embodiment will be described in detail.

Figure 23:
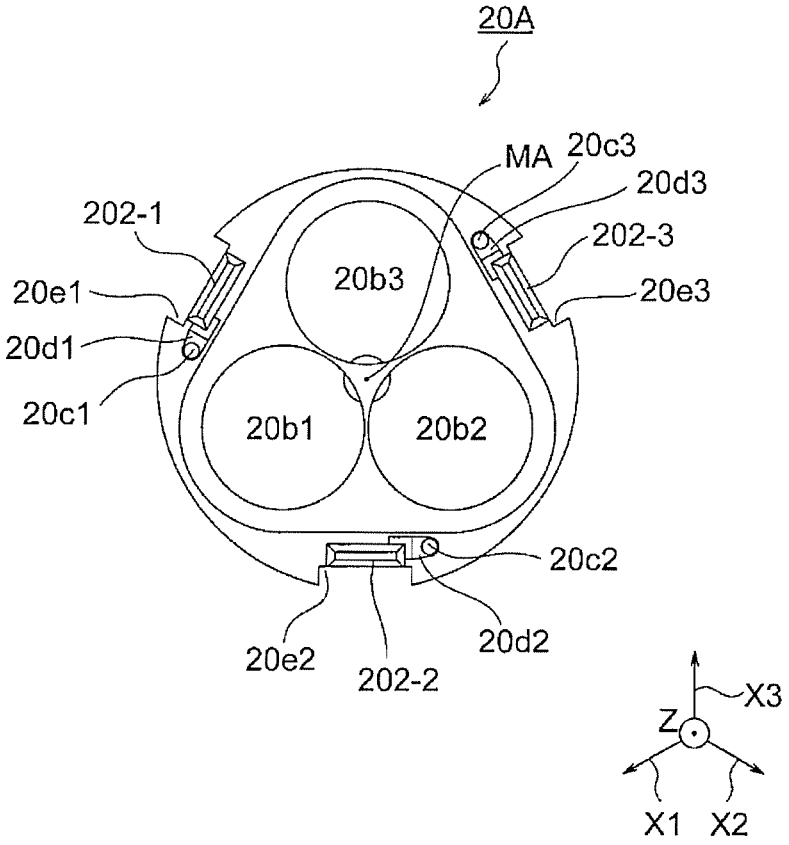
FIG. 23 is a plan view of a supporting-point plate used in the compact pump shown in FIG. 22.

FIG. 23 is a plan view of the supporting-point plate 20A.

The illustrated compact pump 10B has first to third intake holes 20*c*1, 20*c*2, and 20*c*3 for sucking air from outside the case 12A into the housing space RS (see FIG. 3) of the lower case 18.

As shown in FIG. 23, the first to third intake holes 20*c*1, 20*c*2, and 20*c*3 are formed in the vicinities of the first to third plunging pins 202-1, 202-2, and 202-3, respectively. Thus, the first to third intake holes 20*c*1, 20*c*2, and 20*c*3 are arranged around the motor rotation axis MA, that is, in the circumferential direction, so as to be spaced from each other by the same angle (120°).

In the illustrated example, the diameter of each of the first to third intake holes 20c1, 20c2, and 20c3 is equal to 1.0 mm.

Since as described above the number of intake holes is increased from one to three, the compact pump 10B according to the second embodiment can reduce the amount of air sucked per hole without decreasing the amount of external air sucked. This provides an advantage that intake sounds can be weakened.

Figure 24:
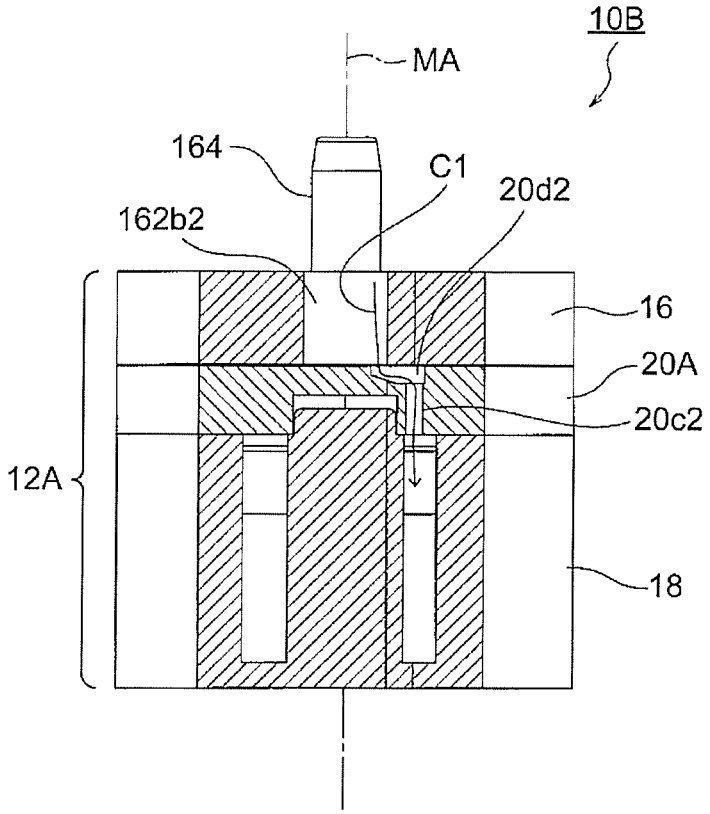
FIG. 24 is a sectional view taken along line XXIV-XXIV in FIG. 22.
Figure 25:
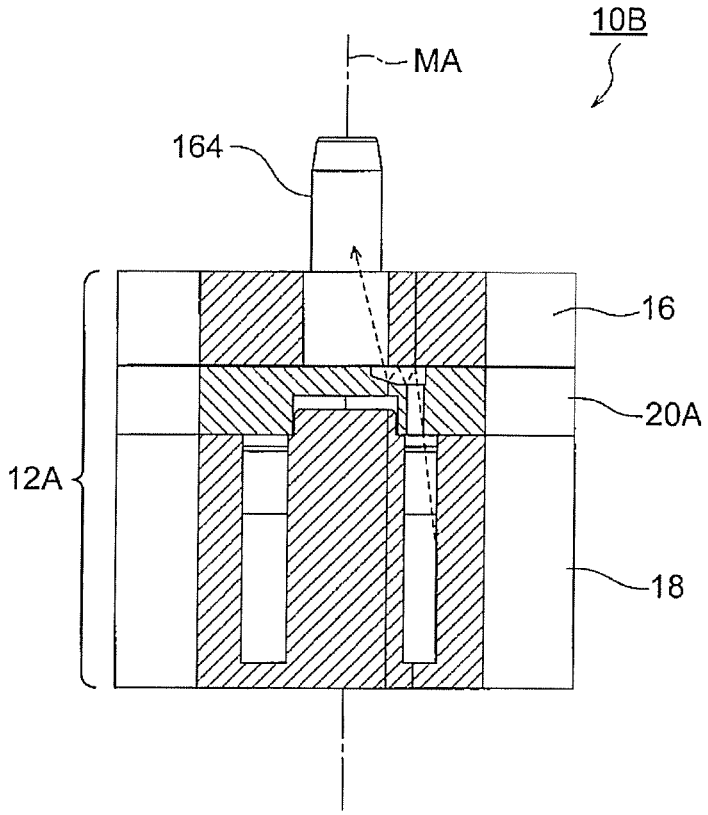
FIG. 25 is a sectional view similar to FIG. 24 and illustrates, as an image, how reflection sounds of suction sounds travel in the suction portion of the compact pump shown in FIG. 22.

FIG. 24 is a sectional view taken along line XXIV-XXIV in FIG. 22. FIG. 25 is a sectional view similar to FIG. 24 and illustrates, as an image, how reflection sounds of suction sounds travel in the suction portion of the compact pump 10B shown in FIG. 22. The image of the traveling reflection sounds is indicated by a broken-line arrow in FIG. 25.

In FIGS. 24 and 25, only the case 12A of the compact pump 10B is shown and the motor 14 is omitted.

As shown in FIGS. 23 and 24, the supporting-point plate 20A further has first to third bypass passages 20d1, 20d2, and 20d3 which provide bypass routes for allowing the gaps in the first to third hook formation rectangular hole 162b1, 162b2, and 162b3 to communicate with the first to third intake holes 20c1, 20c2, and 20c3, respectively.

In the compact pump 10B having the above configuration, air is sucked from outside the case 12A into the housing space RS (see FIG. 3) of the lower case 18 via, for example, the gap between the second hook formation rectangular hole 162b2 and the second plunging pin 1202-2, the second bypass passage 20d2, and the second intake hole 20c2 (indicated by arrow C1 in FIG. 24). As a result, as shown in FIG. 25, a noise sound that is emitted from the second intake hole 20c2 to outside the case 12A can be weakened.

Figure 26:
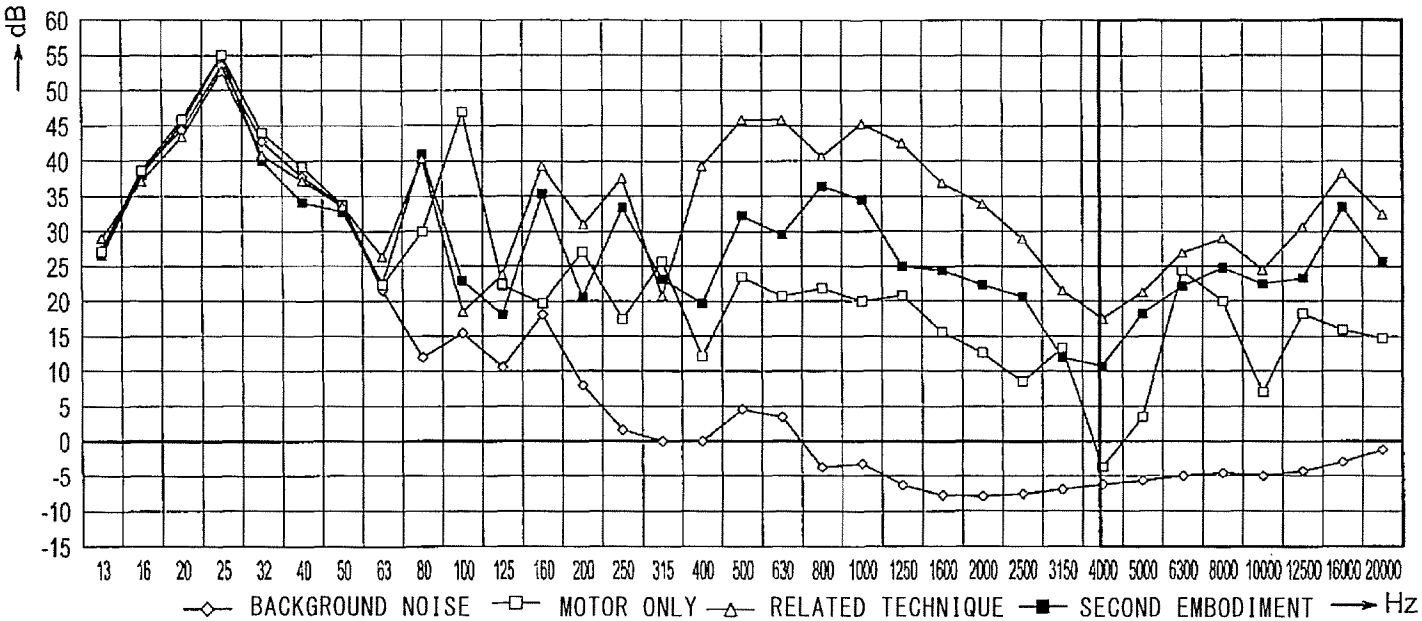
FIG. 26 is a graph showing frequency characteristics of background noise, a noise sound of the motor itself, noise sounds of the compact pump of the related technique, and noise sounds of the compact pump according to the second embodiment.

Next, the noise sounds weakening effect of the compact pump 10 of the related technique shown in FIGS. 1-10 and that of the compact pump 10B according to the second embodiment shown in FIGS. 22-25 will be compared with each other with reference to FIG. 26.

FIG. 26 is a graph showing frequency characteristics of background noise, a noise sound of the motor 14 itself, noise sounds of the compact pump 10 of the related technique, and noise sounds of the compact pump 10B according to the second embodiment. In FIG. 26, the horizontal axis represents the frequency (Hz) and the vertical axis represents the noise level (dB).

It is seen from FIG. 26 that the noise level of the compact pump 10B according to the second embodiment is lower than that of the compact pump 10 of the related technique not only in a frequency range of 100 Hz to 4 kHz but also in a frequency range of 4 to 20 kHz.

As is apparent from the above description, since the supporting-point plate 20A has the plural intake holes 20c1-20c3, the compact pump 10B according to the second embodiment of the invention provides an advantage that noise sounds can be weakened further without increasing the number of components.

Embodiment 3

Figure 27:
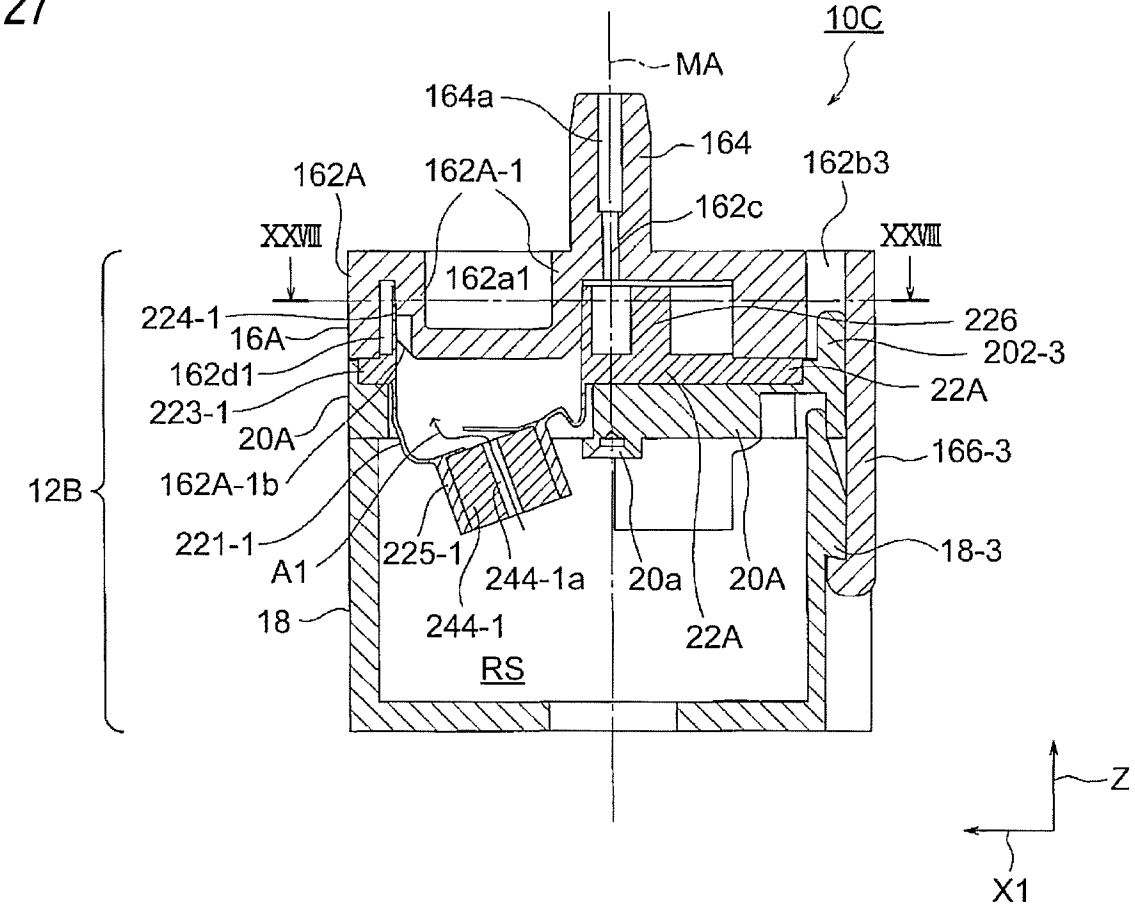
FIG. 27 is a vertical sectional view of a compact pump according to a third embodiment of the invention.
Figure 28:
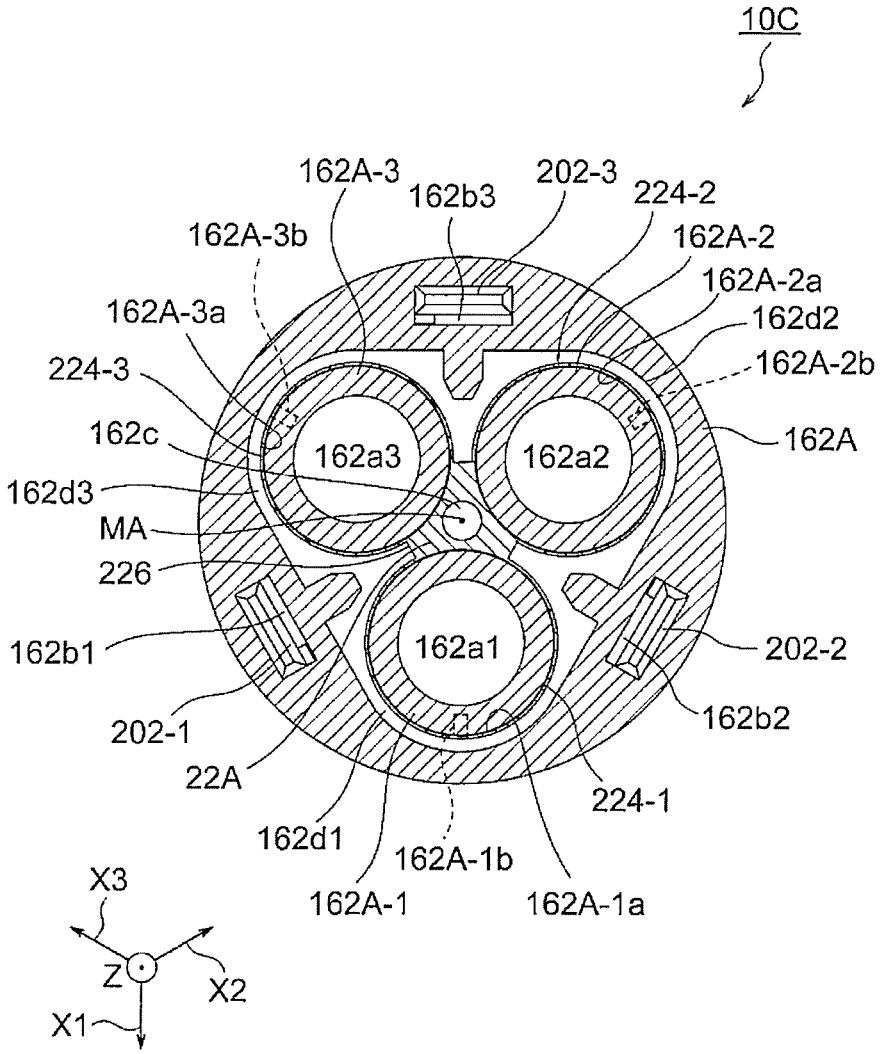
FIG. 28 is a sectional view taken along line XXVIII-XXVIII in FIG. 27.

The configuration of a compact pump 10C according to a third embodiment of the invention will be described with reference to FIGS. 27 and 28. FIG. 27 is a vertical sectional view of the compact pump 10C. FIG. 28 is a sectional view taken along line XXVIII-XXVIII. However, the swing drive means (14, 30, 28, 26) and the drive disc 242 of the swing body 24 are not shown in FIG. 27. FIG. 27 shows a state that the bottom end portion of the first diaphragm unit 1221-1 is moved down by the swing body 24.

The following description will employ a coordinate system (X1, X2, X3, Z) shown in FIGS. 27 and 28. In the state shown in FIGS. 27 and 28, in the coordinate system (X1, X2, X3, Z), the Z direction is the top-bottom direction (vertical direction) in which the motor rotation axis MA extends and the X1, X2, and X3 directions are first to third horizontal directions, respectively, that deviate from each other by the same angle (120°) around the motor rotation axis MA (Z direction) in a plane that is perpendicular to the motor rotation axis MA (Z direction).

The illustrated compact pump 100 has the same configuration and operates in the same manner as the above-described compact pump 10B according to the second embodiment except differences, described below, in the upper cover. Thus, the case and the upper cover of the former are given reference symbols 12B and 16A, respectively. Constituent elements of the compact pump 10C having the same functions as the corresponding ones of the compact pump 10B shown in FIGS. 22-25 are given the same reference symbols as the latter. In the following, to simplify the description, only differences from the compact pump 10B according to the second embodiment will be described in detail.

The upper cover 16A is the same in structure as the upper cover 16 shown in FIGS. 22-25 except that the structure of the cover plate is modified in a manner described below. Thus, the cover plate is given reference symbol 162A.

The cover plate 162A is the same in structure as the cover plate 162 shown in FIGS. 22-25 except that the structure of each of the first to third closed-bottom tubular portions is modified in a manner described below. Thus, the first to third closed-bottom tubular portions are given reference symbols 162A-1, 162A-2, and 162A-3, respectively.

The first to third closed-bottom tubular portions 162A-1, 162A-2, and 162A-3 have first to third exhaust air introduction passages 162A-1b, 162A-2b, and 162A-3b which are formed adjacent to outside end portions of first to third tubular inner wall surfaces 162A-1a, 162A-2a, and 162A-3a, respectively.

In the illustrated example, the first to third exhaust air introduction passages 162A-1b, 162A-2b, and 162A-3b are first to third grooves that are formed adjoining the first to third tubular inner wall surfaces 162A-1a, 162A-2a, and 162A-3a, respectively.

The employment of this structure makes it possible to restrict the ranges where the first to third tubular exhaust valve elements 224-1, 224-2, and 224-3 of the diaphragm assembly 22A operate. It is expected that this structure enhances the sound attenuation effect further.

Exemplary modes of the invention will be described below.

A first exemplary mode of the invention provides a compact pump (10A, 10B, 100) comprising a hollow case (12, 12A, 12B) which is symmetrical with respect to a motor rotation axis (MA); a diaphragm assembly (22A) which is disposed in the case at a upper position and includes first to Nth diaphragm units (221-1 to 221-3) which form first to Nth pump chambers (PC1 to PC3), respectively, N being an integer that is larger than or equal to 2; and a swing body (24) which is disposed in the case at a lower position and moves the first to Nth diaphragm units (221-1 to 221-3) in the top-bottom direction when swung by an eccentric rotary shaft (26), characterized in that the first to Nth diaphragm units (221-1 to 221-3) have first to Nth through-holes (222-1a to 222-3a) at the centers of their bottom portions, respectively; that the swing body (24) has first to Nth air introduction holes (244-1a to 244-3a) which communicate with the first to Nth through-holes (222-1*a* to 222-3*a*), respectively; that the diaphragm assembly (22A) has first to Nth intake valve elements (222-1 to 222-3) which open and close the first to Nth air introduction holes (244-1*a* to 244-3*a*), respectively; that the case (12, 12A, 12B) has an upper cover (16, 16A) which is an upper portion of the case (12, 12A, 12B); that the upper cover has an exhaust hole (162*c*) formed along the motor rotation axis (MA) and first to Nth ring-shaped recesses (162*d*1 to 162*d*3) which are disposed around and communicate with the exhaust hole; that the upper cover (16, 16A) has first to Nth tubular inner wall surfaces (162-1*a* to 162-3*a*; 162A-1*a* to 162A-3*a*) which define the first to Nth ring-shaped recesses, respectively; that the diaphragm assembly (22A) has first to Nth tubular exhaust valve elements (224-1 to 224-3) which are disposed in the first to Nth ring-shaped recesses in a state as to be in contact with the first to Nth tubular inner wall surfaces, respectively; and that the diaphragm assembly (22A) has a rib (226) which is disposed at its center in the vicinity of the exhaust hole (162*c*) and connects center-side outer wall surfaces of the first to Nth tubular exhaust valve elements.

In the above compact pump (10A, 10B, 10C), it is preferable that the first to Nth pump chambers (PC1-PC3) be arranged around the motor rotation axis (MA) so as to be spaced from each other by the same angle in the circumferential direction; and that the first to Nth ring-shaped recesses (162*d*1 to 162*d*3) be arranged around the motor rotation axis (MA) so as to be spaced from each other by the same angle in the circumferential direction. It is desirable that the rib (226) constitute a partition among the first to Nth ring-shaped recesses (162*d*1 to 162*d*3). Furthermore, it is preferable that a distance (A) between a top surface of the rib (226) and a ceiling surface of the upper case (12, 12A, 12B) be set in a range that a volume (V(1)) of a space between the top surface of the rib (226) and the ceiling surface of the upper case (12, 12A, 12B) is larger than a volume (V(2)) of the exhaust hole (162*c*) and smaller than a volume (V(3)) of the first to Nth ring-shaped recesses (162*d*1 to 162*d*3). In particular, it is preferable that the distance (A) between the top surface of the rib (226) and the ceiling surface of the upper case (12, 12A, 12B) be equal to such a minimum distance that the volume V(1) of the space between the top surface of the rib (226) and the ceiling surface of the upper case (12, 12A, 12B) is substantially equal to the volume V(2) of the exhaust hole (162*c*). It is desirable that a distance (B) between the motor rotation axis (MA) and outer circumferential wall surfaces of the rib (226) be set at such a value that the exhaust hole (162*c*) is not seen directly when a top edge (226-1, 226-2, 226-3) of the rib (226) is viewed from an outside edge of the diaphragm assembly (22A) in the radial direction.

In the above compact pump (10B, 10C), it is preferable that the diaphragm assembly (22A) have first to Nth flanges (223-1, 223-2, and 223-3) which project outward from top ends of the first to Nth diaphragm units (221-1 to 221-3), respectively; that the case (12A, 12B) further have a lower case (18) which is a lower portion of the case and has a housing space (RS) which houses the eccentric rotary shaft (26) and the swing body (24), and a supporting-point plate (20A) which supports the first to Nth flanges (223-1 to 223-3) of the diaphragm assembly (22A) in a state as to be sandwiched between the upper cover (16, 16A) and the lower case (18) and has a recess (20*a*) in which a tip portion of the eccentric rotary shaft (26) is fitted loosely; and that the supporting-point plate (20A) have first to Nth intake holes (20*c*1 to 20*c*3) which allow air to be sucked from outside the case (12A, 12B) into the housing space (RS) of the lower case (18). It is desirable that the upper cover (16, 16A) have first to Nth hooks (166-1 to 166-3) which are disposed in the vicinities of the first to Nth intake holes (20*c*1 to 20*c*3), respectively, extend downward from an outer circumferential wall of the upper cover plate (16, 16A), and serve to fix the supporting-point plate (20A) by holding it among them in cooperation with the lower case (18); that the upper cover (16, 16A) have first to Nth hook formation rectangular holes (162*b*1 to 162*b*3) which are formed in the vicinities of the first to Nth hooks (166-1 to 166-3) to form the first to Nth hooks (166-1 to 166-3), respectively; that the supporting-point plate (20A) have first to Nth plunging pins (202-1 to 202-3) which project upward into the first to Nth hook formation rectangular holes (162*b*1 to 162*b*3) with gaps so as to be in contact with inner wall surfaces of the first to Nth hooks (166-1 to 166-3), respectively; and that the supporting-point plate (20A) have first to Nth bypass passages (20*d*1 to 20*d*3) which provide bypass routes for allowing the gaps in the first to Nth hook formation rectangular hole (162*b*1 to 162*b*3) to communicate with the first to Nth intake holes (20*c*1 to 20*c*3), respectively.

In the above compact pump (10C), it is preferable that the upper cover (16A) have first to Nth exhaust air introduction passages (162A-1*b* to 162A-3*b*) which are formed adjacent to outside end portions of the first to Nth tubular inner wall surfaces (162A-1*a* to 162A-3*a*), respectively. For example, the first to Nth exhaust air introduction passages (162A-1*b* to 162A-3*b*) may be first to Nth grooves that are formed adjoining the first to Nth tubular inner wall surfaces (162A-1*a* to 162A-3*a*), respectively.

A second exemplary mode of the invention provides a diaphragm assembly (22A) used in a compact pump (10A, 10B, 100), comprising first to Nth diaphragm units (221-1 to 221-2) which form first to Nth pump chambers (PC1-PC3), respectively, around a motor rotation axis (MA), N being an integer that is larger than or equal to 2; first to Nth intake valve elements (222-1 to 222-3) which are formed at the centers of bottom portions of the first to Nth diaphragm units by cutting away parts of them, respectively; first to Nth flanges (223-1 to and 223-3) which project outward from top ends of the first to Nth diaphragm units, respectively; first to Nth tubular exhaust valve elements (224-1 to 224-3) which project upward from the first to Nth flanges and are thereby connected to the first to Nth diaphragm units, respectively; and a rib (226) which is disposed at the center in the vicinity of the exhaust hole (162*c*) of the compact pump and connects center-side outer wall surfaces of the first to Nth tubular exhaust valve elements.

In the above diaphragm assembly (22A), each of the first to Nth tubular exhaust valve elements (224-1 to 224-3) may have a cylindrical shape. It is preferable that the diaphragm assembly further comprise first to Nth hollow attachment bodies (225-1 to 225-3) which project from bottom surfaces of the first to Nth diaphragm units, respectively. Each of the first to Nth hollow attachment bodies (225-1 to 225-3) may have a cylindrical shape. It is preferable that the first to Nth pump chambers (PC1-PC3) be arranged around the motor rotation axis (MA) so as to be spaced from each other by the same angle in the circumferential direction.

The above parenthesized reference symbols are used to facilitate understanding of the invention; the constituent elements given these reference symbols are just examples and it goes without saying that the invention is not limited to them.

Although the invention has been described above by referring to the embodiments, the invention is not limited to those embodiments. Various modifications that would be understandable by those skilled in the art can be made of the constitution and the details of the invention without departing from the scope of the invention.

For example, although the compact pumps 10A, 10B, and 10C which are of what is called a three cylinder type and are equipped with the first, second, and third pump chambers PC1, PC2, and PC3 have been described in the above embodiments, it goes without saying that the invention can also be applied to compact pumps of two cylinders or four or more cylinders. Furthermore, although the above embodiments are directed to the case that the third to third intake valve elements 222-1, 222-2, and 222-3 are integral with the diaphragm assembly 12A, the third to third intake valve elements 222-1, 222-2, and 222-3 may be separate from the diaphragm assembly 12A.

INDUSTRIAL APPLICABILITY

The application range of the compact pump according to the invention is not limited to compact pumps for supplying air to a blood pressure monitor but include general compact pumps for supplying fluid to household electrical appliances etc.

The present application claims priority from Japanese Patent Application No. 2015-090301 filed on Apr. 27, 2015, the disclosure of which is incorporated herein in its entirety.

DESCRIPTION OF SYMBOLS

10A, 10B, 100: Compact pump
12, 12A, 12B: Case
14: Motor
16, 16A: Upper cover (discharge cover)
16, 162A: Cover plate
162*a*1: First cylindrical recess
162*a*2: Second cylindrical recess
162*a*3: Third cylindrical recess
162*b*1: First hook formation rectangular hole
162*b*2: Second hook formation rectangular hole
162*b*3: Third hook formation rectangular hole
162*c*: Exhaust hole
162*d*1: First ring-shaped recess
162*d*2: Second ring-shaped recess
162*d*3: Third ring-shaped recess
162-1, 162A-1: First closed-bottom tubular portion
162-1*a*, 162A-1*a*: First tubular portion inner wall surface
162A-1*b*: First exhaust air introduction passage
162-2, 162A-2: Second closed-bottom tubular portion
162-2*a*, 162A-2*a*: Second tubular portion inner wall surface
162A-2*b*: Second exhaust air introduction passage
162-3, 162A-3: Third closed-bottom tubular portion
162-3*a*, 162A-3*a*: Third tubular portion inner wall surface
162A-3*b*: Third exhaust air introduction passage
164: Discharge pipe
164*a*: Exhaust hole
166-1: First hook
166-2: Second hook
166-3: Third hook
18: Lower case
18-2: Second hook receiving portion
18-1: Third hook receiving portion
20, 20A: Supporting-point plate
20*a*: Recess
20*b*1: First circular opening
20*b*2: Second circular opening
20*b*3: Third circular opening
20*c*: Intake hole
20*c*1: First intake hole
20*c*2: Second intake hole
20*c*3: Third intake hole
20*d*: Bypass passage
20*d*1: First bypass passage
20*d*2: Second bypass passage
20*d*3: Third bypass passage
20*e*1: First rectangular groove
20*e*2: Second rectangular groove
20*e*3: Third rectangular groove
202-1: First plunging pin
202-2: Second plunging pin
202-3: Third plunging pin
22A: Diaphragm assembly
221-1: First diaphragm unit
221-2: Second diaphragm unit
221-3: Third diaphragm unit
222-1: First intake valve element
222-1*a*: First through-hole
222-2: Second intake valve element
222-2*a*: Second through-hole
222-3: Third intake valve element
222-3*a*: Third through-hole
223-1: First flange
223-2: Second flange
223-3: Third flange
224-1: First tubular exhaust valve element
224-2: Second tubular exhaust valve element
224-3: Third tubular exhaust valve element
225-1: First hollow attachment body
225-2: Second hollow attachment body
226: Rib
24: Swing body
242: Drive disc
244-1: First shaft body
244-1*a*: First air introduction hole
244-2: Second shaft body
244-2*a*: Second air introduction hole
244-3*a*: Third air introduction hole
26: Eccentric rotary shaft
28: Rotary body
30: Rotary drive shaft
MA: Motor rotation axis
PC1: First pump chamber
PC2: Second pump chamber
PC3: Third pump chamber
RS: Housing space
X1: First horizontal direction
X2: Second horizontal direction
X3: Third horizontal direction
Z: Vertical direction (top-bottom direction)

The invention claimed is:

1. A diaphragm assembly used in a compact pump, comprising:

a plurality of diaphragm units which form a plurality of pump chambers, respectively, around a motor rotation axis;

a plurality of intake valve elements which are formed at centers of bottom portions of the plurality of diaphragm units by cutting away parts of the bottom portions, respectively;

a plurality of flanges which project in a direction perpendicular to the motor rotation axis from top ends of the plurality of diaphragm units, respectively;

a plurality of tubular exhaust valve elements which project in an opposite direction to the diaphragm units from the plurality of flanges and are thereby connected to the plurality of diaphragm units, respectively; and a rib which is disposed at a center portion, extends toward an exhaust hole of the compact pump from the plurality of flanges, and connects center-side outer wall surfaces of the plurality of tubular exhaust valve elements.

2. The diaphragm assembly according to claim 1, wherein each of the plurality of tubular exhaust valve elements has a cylindrical shape.

3. The diaphragm assembly according to claim 1, further comprising a plurality of hollow attachment bodies which project from bottom surfaces of the plurality of diaphragm units, respectively.

4. The diaphragm assembly according to claim 3, wherein each of the plurality of hollow attachment bodies has a cylindrical shape.

5. The diaphragm assembly according to according to claim 1, wherein the plurality of pump chambers are arranged around the motor rotation axis so as to be spaced from each other by a same angle in the circumferential direction.

6. The diaphragm assembly according to claim 1, wherein, in a direction of the motor rotation axis, a length of the rib is equal to a length of the plurality of diaphragm units.

7. A compact pump comprising:

a hollow case which is symmetrical with respect to a motor rotation axis extending in a longitudinal direction;

a diaphragm assembly which is disposed in the case at an upper position and includes a plurality of diaphragm units which form a plurality of pump chambers, respectively; and a swing body which is disposed in the case at a lower position and moves the plurality of diaphragm units in the longitudinal direction when swung by an eccentric rotary shaft, wherein:

the plurality of diaphragm units have a plurality of through-holes at centers of bottom portions thereof, respectively;

the swing body has a plurality of air introduction holes which communicate with the plurality of through-holes, respectively;

the diaphragm assembly has a plurality of intake valve elements which open and close the plurality of air introduction holes, respectively;

the case has an upper cover which is provided at an upper portion of the case;

the upper cover has an exhaust hole formed along the motor rotation axis and a plurality of ring-shaped recesses which are disposed around and communicate with the exhaust hole;

the upper cover has a plurality of tubular inner wall surfaces which define the plurality of ring-shaped recesses, respectively;

the diaphragm assembly has a plurality of flanges which project from top ends of the plurality of diaphragm units in a direction perpendicular to the longitudinal direction, respectively;

the diaphragm assembly has a plurality of tubular exhaust valve elements which are disposed in the plurality of ring-shaped recesses in a state that the plurality of tubular exhaust valve elements are in contact with the plurality of tubular inner wall surfaces, respectively; and the diaphragm assembly has a rib which is disposed at a center of the diaphragm assembly, extends toward the exhaust hole from the plurality of flanges, and connects center-side outer wall surfaces of the plurality of tubular exhaust valve elements.

8. The compact pump according to claim 7, wherein:

the plurality of pump chambers are arranged around the motor rotation axis so as to be spaced from each other by a same angle in a circumferential direction; and the plurality of ring-shaped recesses are arranged around the motor rotation axis so as to be spaced from each other by the same angle in a circumferential direction.

9. The compact pump according to claim 7, wherein the rib constitutes a partition among the plurality of ring-shaped recesses.

10. The compact pump according to claim 7, wherein a distance between a top surface of the rib and a ceiling surface of the upper cover is set in a range that a volume of a space between the top surface of the rib and the ceiling surface of the upper cover is larger than a volume of the exhaust hole and smaller than a volume of the plurality of ring-shaped recesses, the volume of the exhaust hole being defined by a cross-sectional area of the exhaust hole and a depth of the exhaust hole which extends in the longitudinal direction.

11. The compact pump according to claim 10, wherein the distance between the top surface of the rib and the ceiling surface of the upper cover is equal to a minimum distance such that the volume of the space between the top surface of the rib and the ceiling surface of the upper cover is equal to the volume of the exhaust hole.

12. The compact pump according to claim 10, wherein a distance between the motor rotation axis and outer circumferential wall surfaces of the rib is set at a value such that the exhaust hole is not seen directly when a top edge of the rib is viewed from an outside edge of the diaphragm assembly in a radial direction.

13. The compact pump according to claim 10, wherein a distance between the motor rotation axis and outer circumferential wall surfaces of the rib is set at a value such that a line of sight from (i) an outside edge of the diaphragm assembly in a radial direction to (ii) the exhaust hole is obstructed by a top edge of the rib.

14. The compact pump according to claim 7, wherein:

the case further has:

a lower case which is a lower portion of the case and has a housing space which houses the eccentric rotary shaft and the swing body; and a supporting-point plate which supports the plurality of flanges of the diaphragm assembly in a state that the supporting-point plate is sandwiched between the upper cover and the lower case and has a recess in which a tip portion of the eccentric rotary shaft is fitted loosely; and the supporting-point plate has a plurality of intake holes which suck air from outside the case into the housing space of the lower case.

15. The compact pump according to claim 14, wherein:

the upper cover has a plurality of hooks which are disposed in vicinities of the plurality of intake holes, respectively, extend downward from an outer circumferential wall of the upper cover, and fix the supporting-point plate by holding it among them in cooperation with the lower case;

the upper cover has a plurality of hook formation rectangular holes which are formed in vicinities of the plurality of hooks to form the plurality of hooks, respectively;

the supporting-point plate has a plurality of plunging pins which project upward into the plurality of hook formation rectangular holes with gaps so as to be in contact with inner wall surfaces of the plurality of hooks, respectively; and the supporting-point plate has a plurality of bypass passages which provide bypass routes for allowing the gaps in the plurality of hook formation rectangular hole to communicate with the plurality of intake holes, respectively.

16. The compact pump according to claim 7, wherein the upper cover has a plurality of exhaust air introduction passages which are formed adjacent to outside end portions of the plurality of tubular inner wall surfaces, respectively.

17. The compact pump according to claim 16, wherein the plurality of exhaust air introduction passages are a plurality of grooves that are formed adjoining the plurality of tubular inner wall surfaces, respectively.

18. The compact pump according to claim 7, wherein, in the longitudinal direction, a length of the rib is equal to a length of the plurality of diaphragm units.

* * * * *